US009659569B2

(12) United States Patent
Vasilache et al.

(10) Patent No.: US 9,659,569 B2
(45) Date of Patent: May 23, 2017

(54) AUDIO SIGNAL ENCODER

(71) Applicant: Nokia Technologies Oy, Espoo (FI)

(72) Inventors: Adriana Vasilache, Tampere (FI); Lasse Juhani Laaksonen, Tampere (FI); Anssi Sakari Rämö, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 14/785,518

(22) PCT Filed: Apr. 26, 2013

(86) PCT No.: PCT/IB2013/053324
§ 371 (c)(1),
(2) Date: Oct. 19, 2015

(87) PCT Pub. No.: WO2014/174344
PCT Pub. Date: Oct. 30, 2014

(65) Prior Publication Data
US 2016/0078877 A1 Mar. 17, 2016

(51) Int. Cl.
*G10L 19/22* (2013.01)
*G10L 19/008* (2013.01)

(52) U.S. Cl.
CPC ..... *G10L 19/22* (2013.01); *G10L 19/008* (2013.01)

(58) Field of Classification Search
CPC ..... G10L 19/008; G10L 19/22
USPC ..... 361/20–23; 704/500
See application file for complete search history.

(56) References Cited

U.S. PATENT DOCUMENTS

| | | | | |
|---|---|---|---|---|
| 2006/0235679 | A1 | 10/2006 | Sperschneider et al. | |
| 2007/0271095 | A1 | 11/2007 | Miyasaka et al. | |
| 2008/0199014 | A1 | 8/2008 | Kurniawati et al. | |
| 2011/0166866 | A1* | 7/2011 | Breebaart | G10L 19/008 704/500 |
| 2012/0035940 | A1 | 2/2012 | Jeong et al. | |
| 2013/0230176 | A1* | 9/2013 | Virette | G10L 19/008 381/22 |

(Continued)

FOREIGN PATENT DOCUMENTS

| | | |
|---|---|---|
| EP | 2144229 | 1/2010 |
| EP | 2144230 | 1/2010 |
| WO | 2004080125 | 9/2004 |

(Continued)

OTHER PUBLICATIONS

International Search Report and Written Opinion received for corresponding Patent Cooperation Treaty Application No. PCT/IB2013/053324 , dated Mar. 26, 2014, 21 pages.

(Continued)

*Primary Examiner* — Melur Ramakrishnaiah
(74) *Attorney, Agent, or Firm* — Nokia Technologies Oy

(57) ABSTRACT

An apparatus comprising: a channel analyzer configured to determine for a first frame of at least one audio signal a set of first frame audio signal multi-channel parameters; a multichannel difference selector configured to select for the first frame groups of elements of the set of first frame audio signal multi-channel parameters based on a value associated with the first frame; and a multichannel parameter encoder configured to generate an encoded first frame audio signal multi-channel parameter based on the selected groups of elements of the set of first frame audio signal multi-channel parameters.

20 Claims, 11 Drawing Sheets

(56) References Cited

U.S. PATENT DOCUMENTS

2014/0023196 A1 1/2014 Xiang et al.

FOREIGN PATENT DOCUMENTS

| | | | |
|---|---|---|---|
| WO | 2004098105 | | 11/2004 |
| WO | 2005101370 | | 10/2005 |
| WO | 2006072270 | | 7/2006 |
| WO | 2008069593 | | 6/2008 |
| WO | 2010091736 | | 8/2010 |
| WO | 2011029984 | | 3/2011 |
| WO | 2012025282 | | 3/2012 |
| WO | 2013/179084 | A1 | 12/2013 |
| WO | 2014/013294 | A1 | 1/2014 |
| WO | 2014/108738 | A1 | 7/2014 |
| WO | 2014/147441 | A1 | 9/2014 |

OTHER PUBLICATIONS

Extended European Search Report received for corresponding European Patent Application No. 13883180.5, dated Nov. 22, 2016, 7 pages.

"Information Technology—MPEG Audio Technologies—Part 1: MPEG Surround", ISO/IEC JTC 1/SC 29, Jul. 21, 2006, 289 pages.

Roden et al., "A Study of the MPEG Surround Quality Versus Bit-Rate Curve", Audio Engineering Society, Oct. 5-8, 2007, pp. 1-15.

"New Annex F With Stereo Embedded Extension for ITU-T G.711.1", International Telecommunication Union, vol. 10, May 9, 2012, pp. 1-52.

"7 KHz Audio-Coding Within 64 kbit/s: New Annex D With Stereo Embedded Extension", International Telecommunication Union, vol. 10, May 8, 2012, pp. 1-52.

* cited by examiner

AUDIO SIGNAL ENCODER

RELATED APPLICATION

This application was originally filed as PCT Application No. PCT/IB2013/053324 filed Apr. 26, 2013.

FIELD

The present application relates to a multichannel or stereo audio signal encoder, and in particular, but not exclusively to a multichannel or stereo audio signal encoder for use in portable apparatus.

BACKGROUND

Audio signals, like speech or music, are encoded for example to enable efficient transmission or storage of the audio signals.

Audio encoders and decoders (also known as codecs) are used to represent audio based signals, such as music and ambient sounds (which in speech coding terms can be called background noise). These types of coders typically do not utilise a speech model for the coding process, rather they use processes for representing all types of audio signals, including speech. Speech encoders and decoders (codecs) can be considered to be audio codecs which are optimised for speech signals, and can operate at either a fixed or variable bit rate.

An audio codec can also be configured to operate with varying bit rates. At lower bit rates, such an audio codec may be optimized to work with speech signals at a coding rate equivalent to a pure speech codec. At higher bit rates, the audio codec may code any signal including music, background noise and speech, with higher quality and performance. A variable-rate audio codec can also implement an embedded scalable coding structure and bitstream, where additional bits (a specific amount of bits is often referred to as a layer) improve the coding upon lower rates, and where the bitstream of a higher rate may be truncated to obtain the bitstream of a lower rate coding. Such an audio codec may utilize a codec designed purely for speech signals as the core layer or lowest bit rate coding.

An audio codec is designed to maintain a high (perceptual) quality while improving the compression ratio. Thus instead of waveform matching coding it is common to employ various parametric schemes to lower the bit rate. For multichannel audio, such as stereo signals, it is common to use a larger amount of the available bit rate on a mono channel representation and encode the stereo or multichannel information exploiting a parametric approach which uses relatively fewer bits.

SUMMARY

There is provided according to a first aspect a method comprising: determining for a first frame of at least one audio signal a set of first frame audio signal multi-channel parameters; selecting for the first frame groups of elements of the set of first frame audio signal multi-channel parameters based on a value associated with the first frame; and generating an encoded first frame audio signal multi-channel parameter based on the selected groups of elements of the set of first frame audio signal multi-channel parameters.

The method may further comprise determining a coding bitrate for the first frame of at least one audio signal; and wherein selecting for the first frame groups of sub-sets of the set of first frame audio signal multi-channel parameters based on a value associated with the first frame comprises selecting the groups of elements of the set of first frame audio signal multi-channel parameters further based on the coding bitrate for the first frame of the at least one audio signal.

Determining for a first frame of at least one audio signal a set of first frame audio signal multi-channel parameters may comprise determining a set of differences between at least two channels of the at least one audio signal, wherein the set of differences comprises two or more difference values, where each difference value is associated with a sub-division of resources defining the first frame.

Determining a set of differences between at least two channels of the at least one audio signal may comprise determining at least one of: at least one interaural time difference; and at least one interaural level difference.

The sub-division of resources defining the first frame may comprise at least one of: sub-band frequencies; and time periods.

Selecting for the first frame groups of elements of the set of first frame audio signal multi-channel parameters based on a value associated with the first frame may comprise: determining a number of the elements within the set of first frame audio signal multichannel parameters; determining a number of groups of elements to be selected; and arranging the elements into the number of groups by grouping successively indexed elements such that in each group there are the rounded result of the number of the elements within the set divided by the number of groups of elements to be selected.

Selecting for the first frame groups of elements of the set of first frame audio signal multi-channel parameters based on a value associated with the first frame may comprise: generating first groups of elements of the set of first frame audio signal multi-channel parameters, with a first number of elements per group; and generating second groups of elements of the set of first frame audio signal multi-channel parameters, with a second number of elements per group.

Generating first groups of elements of the set of first frame audio signal multi-channel parameters, with a first number of elements per group may comprise generating first groups of elements where the elements represent lower frequency first frame audio signal multi-channel parameters and generating second groups of elements of the set of first frame audio signal multi-channel parameters, with a second number of elements per group may comprise generating second groups of elements where the elements represent higher frequency first frame audio signal multi-channel parameters.

Generating an encoded first frame audio signal multi-channel parameter based on the selected groups of elements of the set of first frame audio signal multi-channel parameters may comprise generating an encoded parameter for each of the groups of elements of the at least one first frame audio signal multi-channel parameter using vector or scalar quantization codebooks.

Generating the encoded parameter for each of the groups of elements of the at least one first frame audio signal multi-channel parameter using vector or scalar quantization codebooks may comprise: generating a first encoding mapping with an associated index for the at least one first frame audio signal multi-channel parameter dependent on a frequency distribution of mapping instances of the at least one group of elements of the first frame audio signal multi-channel parameter; and encoding the first encoding mapping dependent on the associated index.

Encoding the first encoding mapping dependent on the associated index may comprise applying a Golomb-Rice encoding to the first encoding mapping dependent on the associated index.

The method may further comprise: receiving at least two audio signal channels; determining a fewer number of channels audio signal from the at least two audio signal channels and the at least one first frame audio signal multi-channel parameter, generating an encoded audio signal comprising the fewer number of channels; and combining the encoded audio signal and the encoded at least one first frame audio signal multi-channel parameter.

According to a second aspect there is provided a method comprising: receiving within a first period a encoded audio signal comprising at least one first frame downmix audio signal and at least one multi-channel audio signal parameter signal comprising groups of elements of a set of first frame audio signal multi-channel parameters; recovering from the groups of elements of the set of first frame audio signal multi-channel parameters individual elements of the first frame audio signal multi-channel parameters; and generating for the frame at least two channel audio signals from the at least one first frame downmix audio signal and the individual elements of the first frame audio signal multi-channel parameters.

The set of first frame audio signal multi-channel parameters may comprise a set of differences between at least two channels of at least one audio signal, wherein the set of differences comprises two or more difference values, where each difference value is associated with a sub-division of resources defining the first frame.

The set of differences between at least two channels of the at least one audio signal may comprise at least one of: at least one interaural time difference; and at least one interaural level difference.

The sub-division of resources defining the first frame may comprise at least one of: sub-band frequencies; and time periods.

According to a third aspect there is provided an apparatus comprising: means for determining for a first frame of at least one audio signal a set of first frame audio signal multi-channel parameters; means for selecting for the first frame groups of elements of the set of first frame audio signal multi-channel parameters based on a value associated with the first frame; and means for generating an encoded first frame audio signal multi-channel parameter based on the selected groups of elements of the set of first frame audio signal multi-channel parameters.

The apparatus may further comprise means for determining a coding bitrate for the first frame of at least one audio signal; and wherein the means for selecting for the first frame groups of sub-sets of the set of first frame audio signal multi-channel parameters based on a value associated with the first frame may comprise means for selecting the groups of elements of the set of first frame audio signal multi-channel parameters further based on the coding bitrate for the first frame of the at least one audio signal.

The means for determining for a first frame of at least one audio signal a set of first frame audio signal multi-channel parameters may comprise means for determining a set of differences between at least two channels of the at least one audio signal, wherein the set of differences may comprise two or more difference values, where each difference value is associated with a sub-division of resources defining the first frame.

The means for determining a set of differences between at least two channels of the at least one audio signal may comprise means for determining at least one of: at least one interaural time difference; and at least one interaural level difference.

The sub-division of resources defining the first frame may comprise at least one of: sub-band frequencies; and time periods.

The means for selecting for the first frame groups of elements of the set of first frame audio signal multi-channel parameters based on a value associated with the first frame may comprise: means for determining a number of the elements within the set of first frame audio signal multi-channel parameters; means for determining a number of groups of elements to be selected; and means for arranging the elements into the number of groups by grouping successively indexed elements such that in each group there are the rounded result of the number of the elements within the set divided by the number of groups of elements to be selected.

The means for selecting for the first frame groups of elements of the set of first frame audio signal multi-channel parameters based on a value associated with the first frame may comprise: means for generating first groups of elements of the set of first frame audio signal multi-channel parameters, with a first number of elements per group; and means for generating second groups of elements of the set of first frame audio signal multi-channel parameters, with a second number of elements per group.

The means for generating first groups of elements of the set of first frame audio signal multi-channel parameters, with a first number of elements per group may comprise means for generating first groups of elements where the elements represent lower frequency first frame audio signal multi-channel parameters and the means for generating second groups of elements of the set of first frame audio signal multi-channel parameters, with a second number of elements per group comprises means for generating second groups of elements where the elements represent higher frequency first frame audio signal multi-channel parameters.

The means for generating an encoded first frame audio signal multi-channel parameter based on the selected groups of elements of the set of first frame audio signal multi-channel parameters may comprise means for generating an encoded parameter for each of the groups of elements of the at least one first frame audio signal multi-channel parameter using vector or scalar quantization codebooks.

The means for generating the encoded parameter for each of the groups of elements of the at least one first frame audio signal multi-channel parameter using vector or scalar quantization codebooks may comprise: means for generating a first encoding mapping with an associated index for the at least one first frame audio signal multi-channel parameter dependent on a frequency distribution of mapping instances of the at least one group of elements of the first frame audio signal multi-channel parameter; and means for encoding the first encoding mapping dependent on the associated index.

The means for encoding the first encoding mapping dependent on the associated index may comprise means for applying a Golomb-Rice encoding to the first encoding mapping dependent on the associated index.

The apparatus may further comprise: means for receiving at least two audio signal channels; means for determining a fewer number of channels audio signal from the at least two audio signal channels and the at least one first frame audio signal multi-channel parameter; means for generating an encoded audio signal comprising the fewer number of channels; and means for combining the encoded audio signal and the encoded at least one first frame audio signal multi-channel parameter.

According to a fourth aspect there is provided an apparatus comprising: means for receiving within a first period an encoded audio signal comprising at least one first frame downmix audio signal and at least one multi-channel audio signal parameter signal comprising groups of elements of the set of first frame audio signal multi-channel parameters; means for recovering from the groups of elements of the set of first frame audio signal multi-channel parameters individual elements of the set of audio signal multi-channel parameters; and means for generating for the frame at least two channel audio signals from the at least one first frame downmix audio signal and the individual elements of the set of audio signal multi-channel parameters.

The set of first frame audio signal multi-channel parameters may comprise a set of differences between at least two channels of at least one audio signal, wherein the set of differences may comprise two or more difference values, where each difference value is associated with a sub-division of resources defining the first frame.

The set of differences between at least two channels of the at least one audio signal may comprise at least one of: at least one interaural time difference; and at least one interaural level difference.

The sub-division of resources defining the first frame may comprise at least one of: sub-band frequencies; and time periods.

According to a fifth aspect there is provided an apparatus comprising at least one processor and at least one memory including computer program code for one or more programs, the at least one memory and the computer program code configured to, with the at least one processor, cause the apparatus at least to: determine for a first frame of at least one audio signal a set of first frame audio signal multi-channel parameters; select for the first frame groups of elements of the set of first frame audio signal multi-channel parameters based on a value associated with the first frame; and generate an encoded first frame audio signal multi-channel parameter based on the selected groups of elements of first frame audio signal multi-channel parameters.

The apparatus may further be caused to perform determine a coding bitrate for the first frame of at least one audio signal; and wherein selecting for the first frame groups of sub-sets of the set of first frame audio signal multi-channel parameters based on a value associated with the first frame may cause the apparatus to select the groups of elements of the set of first frame audio signal multi-channel parameters further based on the coding bitrate for the first frame of the at least one audio signal.

Determining for a first frame of at least one audio signal a set of first frame audio signal multi-channel parameters may cause the apparatus to determine a set of differences between at least two channels of the at least one audio signal, wherein the set of differences comprises two or more difference values, where each difference value is associated with a sub-division of resources defining the first frame.

Determining a set of differences between at least two channels of the at least one audio signal may cause the apparatus to determine at least one of: at least one interaural time difference; and at least one interaural level difference.

The sub-division of resources defining the first frame may comprise at least one of: sub-band frequencies; and time periods.

Selecting for the first frame groups of elements of the set of first frame audio signal multi-channel parameters based on a value associated with the first frame may cause the apparatus to: determine a number of the elements within the set of first frame audio signal multichannel parameters; determine a number of groups of elements to be selected; and arrange the elements into the number of groups by grouping successively indexed elements such that in each group there are the rounded result of the number of the elements within the set divided by the number of groups of elements to be selected.

Selecting for the first frame groups of elements of the set of first frame audio signal multi-channel parameters based on a value associated with the first frame may cause the apparatus to: generate first groups of elements of the set of first frame audio signal multi-channel parameters, with a first number of elements per group; and generate second groups of elements of the set of first frame audio signal multi-channel parameters, with a second number of elements per group.

Generating first groups of elements of the set of first frame audio signal multi-channel parameters, with a first number of elements per group may cause the apparatus to generate first groups of elements where the elements represent lower frequency first frame audio signal multi-channel parameters and generating second groups of elements of the set of first frame audio signal multi-channel parameters, with a second number of elements per group may cause the apparatus to generate second groups of elements where the elements represent higher frequency first frame audio signal multi-channel parameters.

Generating an encoded first frame audio signal multi-channel parameter based on the selected groups of elements of the set of first frame audio signal multi-channel parameters may cause the apparatus to generate an encoded parameter for each of the groups of elements of the at least one first frame audio signal multi-channel parameter using vector or scalar quantization codebooks.

Generating the encoded parameter for each of the groups of elements of the at least one first frame audio signal multi-channel parameter using vector or scalar quantization codebooks may cause the apparatus to: generate a first encoding mapping with an associated index for the at least one first frame audio signal multi-channel parameter dependent on a frequency distribution of mapping instances of the at least one group of elements of the first frame audio signal multi-channel parameter; and encode the first encoding mapping dependent on the associated index.

Encoding the first encoding mapping dependent on the associated index may cause the apparatus to apply a Golomb-Rice encoding to the first encoding mapping dependent on the associated index.

The apparatus may further be caused to: receive at least two audio signal channels; determine a fewer number of channels audio signal from the at least two audio signal channels and the at least one first frame audio signal multi-channel parameter; generate an encoded audio signal comprising the fewer number of channels; and combine the encoded audio signal and the encoded at least one first frame audio signal multi-channel parameter.

According to a sixth aspect there is provided an apparatus comprising at least one processor and at least one memory including computer program code for one or more programs, the at least one memory and the computer program code configured to, with the at least one processor, cause the apparatus at least to: receive within a first period a encoded audio signal comprising at least one first frame downmix audio signal and at least one multi-channel audio signal parameter signal comprising groups of elements of the set of first frame audio signal multi-channel parameters; recover from the groups of elements of the set of first frame audio signal multi-channel parameters individual elements of the set of audio signal multi-channel parameters; and generate for the frame at least two channel audio signals from the at least one first frame downmix audio signal and the combination of the a sub-set of a set of first frame audio signal multi-channel parameters and recovered individual elements of the set of audio signal multi-channel parameters.

The set of first frame audio signal multi-channel parameters may comprise a set of differences between at least two channels of at least one audio signal, wherein the set of differences comprises two or more difference values, where each difference value is associated with a sub-division of resources defining the first frame.

The set of differences between at least two channels of the at least one audio signal may comprise at least one of: at least one interaural time difference; and at least one interaural level difference.

The sub-division of resources defining the first frame may comprise at least one of: sub-band frequencies; and time periods.

According to a seventh aspect there is provided an apparatus comprising: a channel analyser configured to determine for a first frame of at least one audio signal a set of first frame audio signal multi-channel parameters; a multichannel difference selector configured to select for the first frame groups of elements of the set of first frame audio signal multi-channel parameters based on a value associated with the first frame; and a multichannel parameter encoder configured to generate an encoded first frame audio signal multi-channel parameter based on the selected groups of elements of the set of first frame audio signal multi-channel parameters.

The apparatus may further comprise a bit rate determiner configured to determine a coding bitrate for the first frame of at least one audio signal; and wherein multichannel difference selector may be configured to select the groups of elements of the set of first frame audio signal multi-channel parameters further based on the coding bitrate for the first frame of the at least one audio signal.

The channel analyser may be configured to determine a set of differences between at least two channels of the at least one audio signal, wherein the set of differences comprises two or more difference values, where each difference value is associated with a sub-division of resources defining the first frame.

The channel analyser configured to determining a set of differences between at least two channels of the at least one audio signal may be configured to determine at least one of: at least one interaural time difference; and at least one interaural level difference.

The sub-division of resources defining the first frame may comprise at least one of: sub-band frequencies; and time periods.

The multichannel difference selector may comprise: a difference determiner configured to determine a number of the elements within the set of first frame audio signal multichannel parameters; determine a number of groups of elements to be selected; and arrange the elements into the number of groups by grouping successively indexed elements such that in each group there are the rounded result of the number of the elements within the set divided by the number of groups of elements to be selected.

The multichannel difference selector may be configured to: generate first groups of elements of the set of first frame audio signal multi-channel parameters, with a first number of elements per group; and generate second groups of elements of the set of first frame audio signal multi-channel parameters, with a second number of elements per group.

The multichannel difference selector configured to generate first groups of elements of the set of first frame audio signal multi-channel parameters, with a first number of elements per group may be configured to generate first groups of elements where the elements represent lower frequency first frame audio signal multi-channel parameters and the multichannel difference selector further configured to generate second groups of elements of the set of first frame audio signal multi-channel parameters, with a second number of elements per group may be configured to generate second groups of elements where the elements represent higher frequency first frame audio signal multi-channel parameters.

The multichannel parameter encoder may be configured to generate an encoded parameter for each of the groups of elements of the at least one first frame audio signal multichannel parameter using vector or scalar quantization codebooks.

The multichannel parameter encoder configured to generate the encoded parameter for each of the groups of elements of the at least one first frame audio signal multichannel parameter using vector or scalar quantization codebooks may be configured to: generate a first encoding mapping with an associated index for the at least one first frame audio signal multi-channel parameter dependent on a frequency distribution of mapping instances of the at least one group of elements of the first frame audio signal multi-channel parameter and encode the first encoding mapping dependent on the associated index.

The multichannel parameter encoder configured to encode the first encoding mapping dependent on the associated index may be configured to apply a Golomb-Rice encoding to the first encoding mapping dependent on the associated index.

The apparatus may further comprise: an input configured to receiving at least two audio signal channels; a downmixer configured to determine a fewer number of channels audio signal from the at least two audio signal channels and the at least one first frame audio signal multi-channel parameter; a downmixer parameter encoder configured to generate an encoded audio signal comprising the fewer number of channels; and a multiplexer configured to combine the encoded audio signal and the encoded at least one first frame audio signal multi-channel parameter.

According to an eighth aspect there is provided an apparatus comprising: an input configured to receive within a first period a encoded audio signal comprising at least one first frame downmix audio signal and at least one multichannel audio signal parameter signal comprising groups of elements of a set of first frame audio signal multi-channel parameters; a parameter set compiler configured to recover from the groups of elements of the set of first frame audio signal multi-channel parameters individual elements of the set of audio signal multi-channel parameters; and a multichannel generator configured to generate for the frame at least two channel audio signals from the at least one first frame downmix audio signal and the combination of the recovered individual elements of the set of audio signal multi-channel parameters.

The set of first frame audio signal multi-channel parameters may comprise a set of differences between at least two channels of at least one audio signal, wherein the set of differences comprises two or more difference values, where each difference value is associated with a sub-division of resources defining the first frame.

The set of differences between at least two channels of the at least one audio signal may comprise at least one of: at least one interaural time difference; and at least one interaural level difference.

The sub-division of resources defining the first frame may comprise at least one of: sub-band frequencies; and time periods.

A computer program product may cause an apparatus to perform the method as described herein.

An electronic device may comprise apparatus as described herein.

A chipset may comprise apparatus as described herein.

BRIEF DESCRIPTION OF DRAWINGS

For better understanding of the present invention, reference will now be made by way of example to the accompanying drawings in which.

DESCRIPTION OF SOME EMBODIMENTS OF THE APPLICATION

The following describes in more detail possible stereo and multichannel speech and audio codecs, including layered or scalable variable rate speech and audio codecs. However current low bit rate binaural extension layers produce a poor quality decoded binaural signal. This is caused by lack of resolution in the quantization of the binaural parameters (delays and level differences) or by the fact that not all subbands are represented by their corresponding binaural parameter in the encoded bitstream. This is because conventional bitrate constraints for the binaural extension has led to the quantization resolution of the parameters to be decreased (and therefore allowing fewer representation levels) or not all of the subbands are represented by a corresponding parameter. Furthermore typical level differences parameters are coded starting from the higher subbands downwards, for as many subbands as there are bits available thus generating binaural extensions which typically do not generate lower frequency representations.

The concept for the embodiments as described herein is to attempt to generate a stereo or multichannel audio coding that produces efficient high quality and low bit rate stereo (or multichannel) signal coding.

The concept for the embodiments as described herein is thus to generate a coding scheme such that given a number of bits available for the binaural extension for a first frame the channel differences (such as level differences) which represent subbands could be grouped at the coding stage such that for a group of subbands only one parameter is transmitted. The group size can in some embodiments be dependent on the available bitrate. The common value that should be transmitted per group is chosen such that the overall quantization distortion is minimized.

Figure 1:
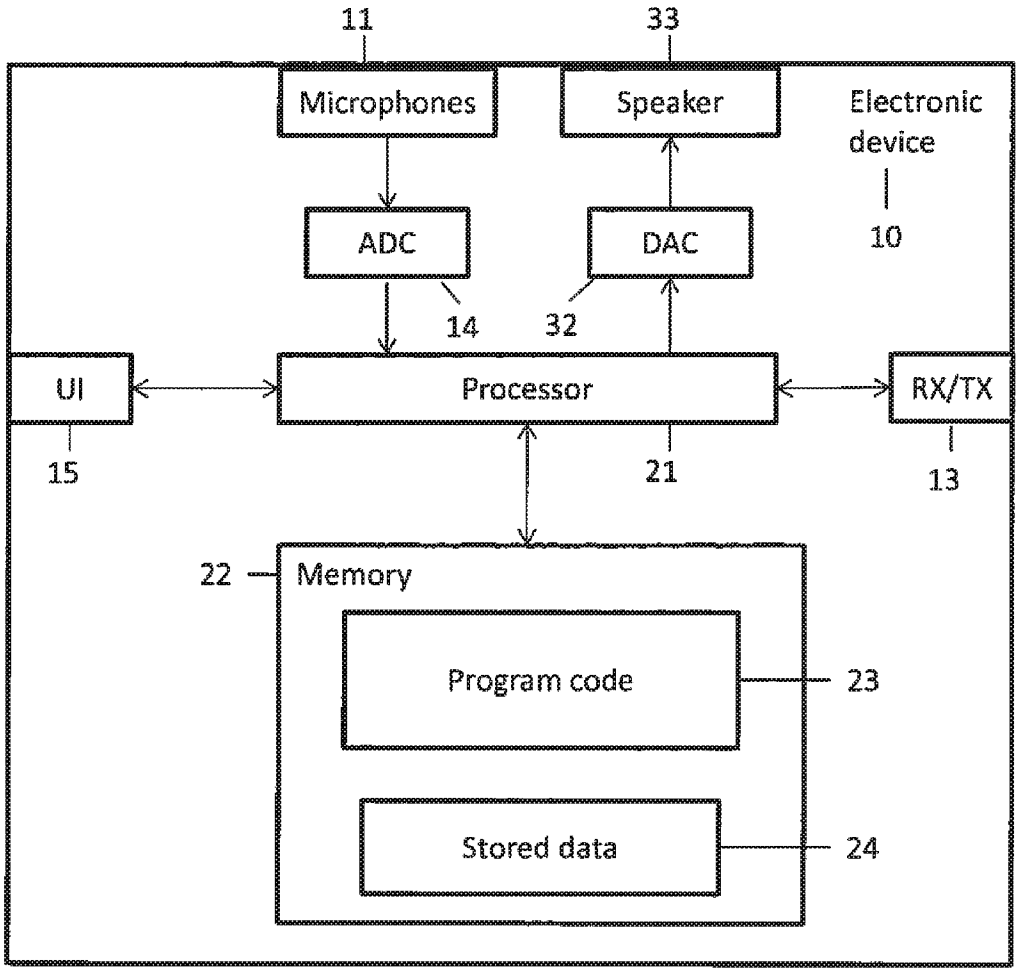
FIG. 1 shows schematically an electronic device employing some embodiments.

In this regard reference is first made to FIG. 1 which shows a schematic block diagram of an exemplary electronic device or apparatus 10, which may incorporate a codec according to an embodiment of the application.

The apparatus 10 may for example be a mobile terminal or user equipment of a wireless communication system. In other embodiments the apparatus 10 may be an audio-video device such as video camera, a Television (TV) receiver, audio recorder or audio player such as a mp3 recorder/player, a media recorder (also known as a mp4 recorder/player), or any computer suitable for the processing of audio signals.

The electronic device or apparatus 10 in some embodiments comprises a microphone 11, which is linked via an analogue-to-digital converter (ADC) 14 to a processor 21. The processor 21 is further linked via a digital-to-analogue (DAC) converter 32 to loudspeakers 33. The processor 21 is further linked to a transceiver (RX/TX) 13, to a user interface (UI) 15 and to a memory 22.

The processor 21 can in some embodiments be configured to execute various program codes. The implemented program codes in some embodiments comprise a multichannel or stereo encoding or decoding code as described herein. The implemented program codes 23 can in some embodiments be stored for example in the memory 22 for retrieval by the processor 21 whenever needed. The memory 22 could further provide a section 24 for storing data, for example data that has been encoded in accordance with the application.

The encoding and decoding code in embodiments can be implemented in hardware and/or firmware.

The user interface 15 enables a user to input commands to the electronic device 10, for example via a keypad, and/or to obtain information from the electronic device 10, for example via a display. In some embodiments a touch screen may provide both input and output functions for the user interface. The apparatus 10 in some embodiments comprises a transceiver 13 suitable for enabling communication with other apparatus, for example via a wireless communication network.

It is to be understood again that the structure of the apparatus 10 could be supplemented and varied in many ways.

A user of the apparatus 10 for example can use the microphones 11, or array of microphones, for inputting speech or other audio signals that are to be transmitted to some other apparatus or that are to be stored in the data section 24 of the memory 22. A corresponding application in some embodiments can be activated to this end by the user via the user interface 15. This application in these embodiments can be performed by the processor 21, causes the processor 21 to execute the encoding code stored in the memory 22.

The analogue-to-digital converter (ADC) 14 in some embodiments converts the input analogue audio signal into a digital audio signal and provides the digital audio signal to the processor 21. In some embodiments the microphone 11 can comprise an integrated microphone and ADC function and provide digital audio signals directly to the processor for processing.

Figure 8:
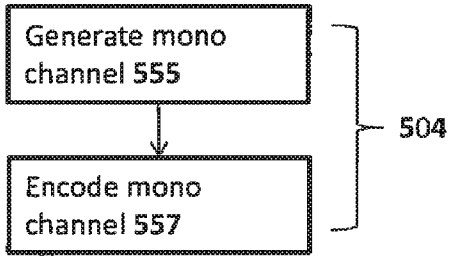
FIG. 8 shows a flow diagram illustrating the operation of the mono parameter encoder as shown in FIG. 4 according to some embodiments.
Figure 9:
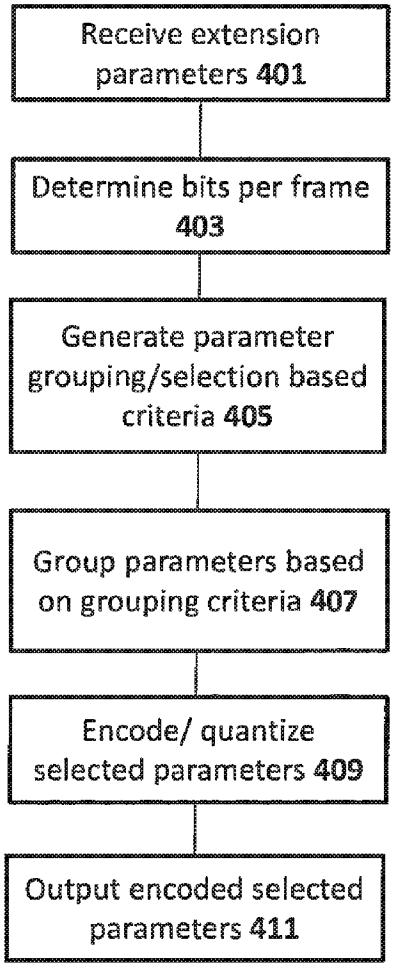
FIG. 9 shows a flow diagram illustrating the operation of the stereo parameter encoder as shown in FIG. 5 according to some embodiments.
Figure 10:
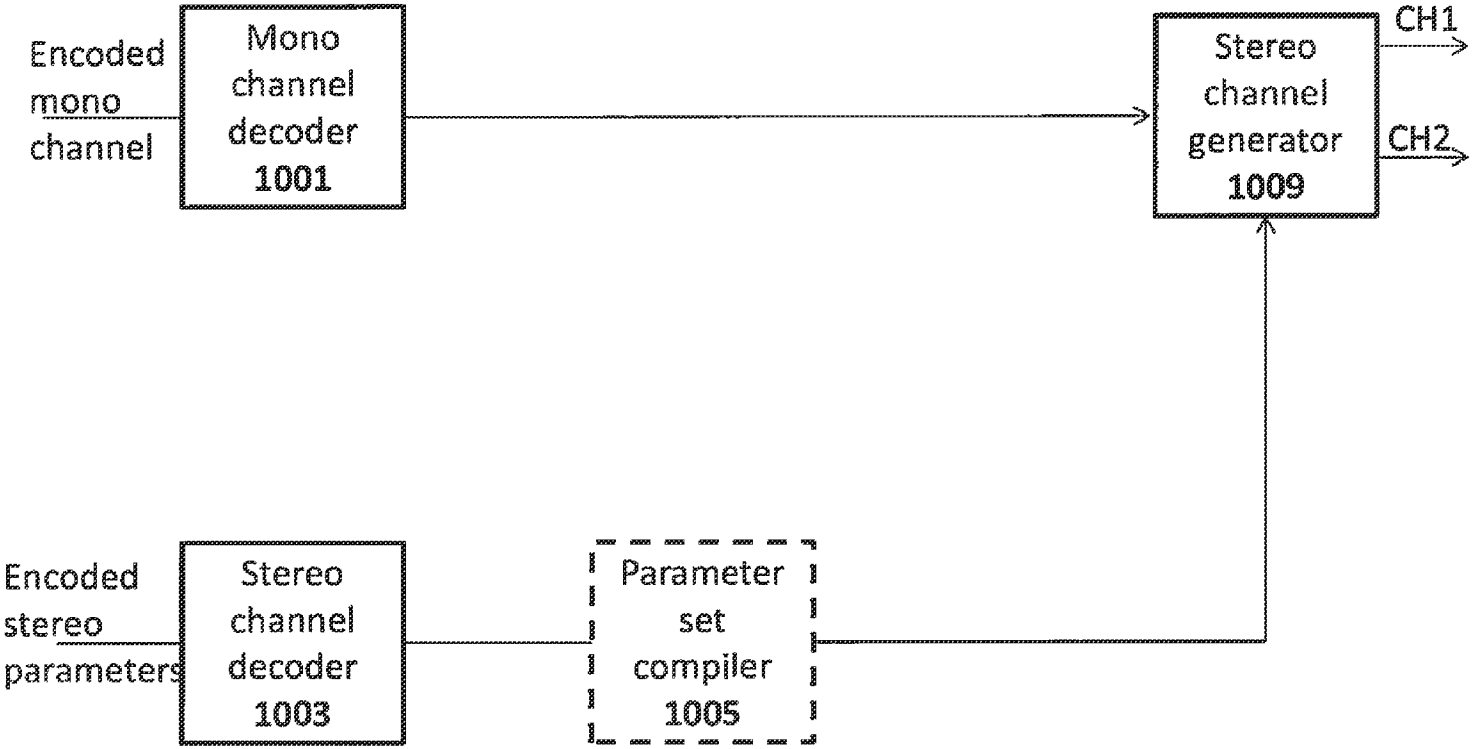
FIG. 10 shows schematically a decoder as shown in FIG. 2 according to some embodiments.

The processor 21 in such embodiments then processes the digital audio signal in the same way as described with reference to the system shown in FIG. 2, the encoder shown in FIGS. 3 to 8 and the decoder as shown in FIGS. 9 and 10.

The resulting bit stream can in some embodiments be provided to the transceiver 13 for transmission to another apparatus. Alternatively, the coded audio data in some embodiments can be stored in the data section 24 of the memory 22, for instance for a later transmission or for a later presentation by the same apparatus 10.

The apparatus 10 in some embodiments can also receive a bit stream with correspondingly encoded data from another apparatus via the transceiver 13. In this example, the processor 21 may execute the decoding program code stored in the memory 22. The processor 21 in such embodiments decodes the received data, and provides the decoded data to a digital-to-analogue converter 32. The digital-to-analogue converter 32 converts the digital decoded data into analogue audio data and can in some embodiments output the analogue audio via the loudspeakers 33. Execution of the decoding program code in some embodiments can be triggered as well by an application called by the user via the user interface 15.

The received encoded data in some embodiment can also be stored instead of an immediate presentation via the loudspeakers 33 in the data section 24 of the memory 22, for instance for later decoding and presentation or decoding and forwarding to still another apparatus.

Figure 4:
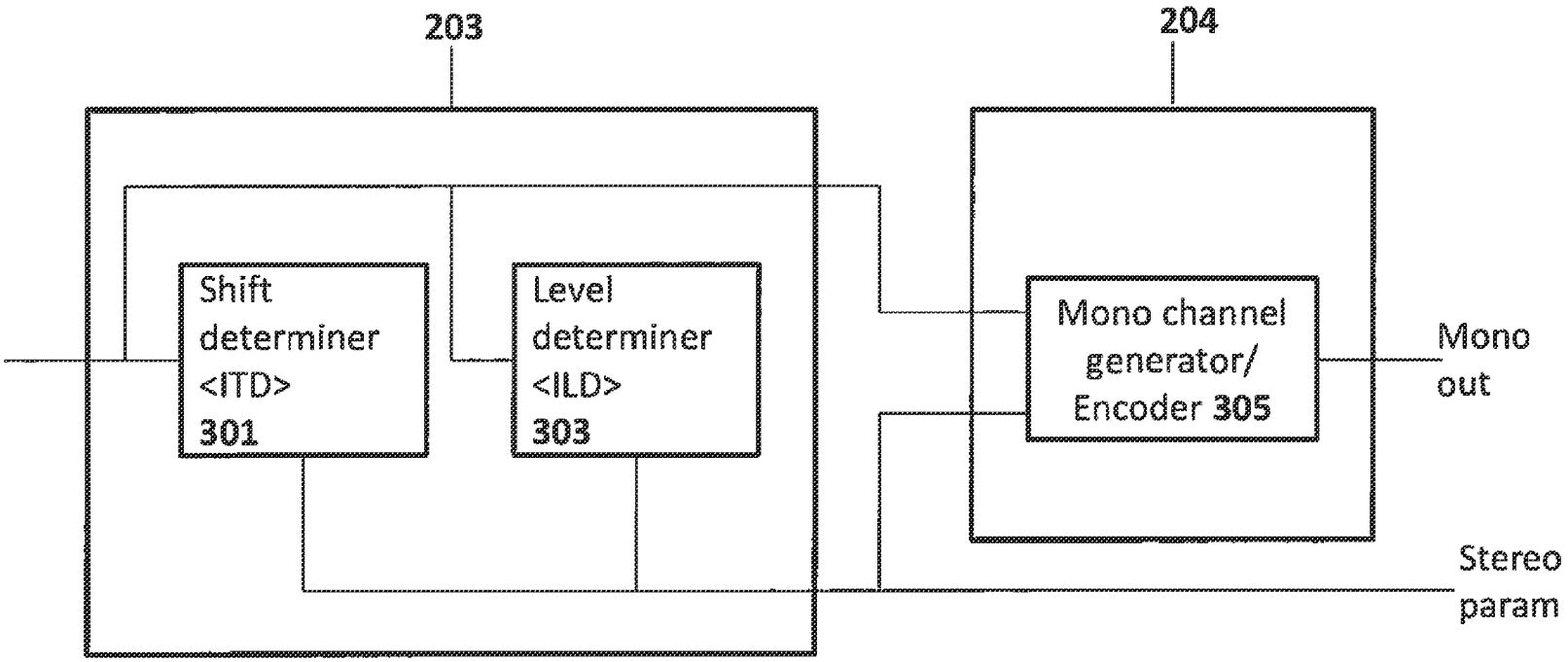
FIG. 4 shows schematically a channel analyser and mono parameter encoder as shown in FIG. 3 in further detail according to some embodiments.
Figure 5:
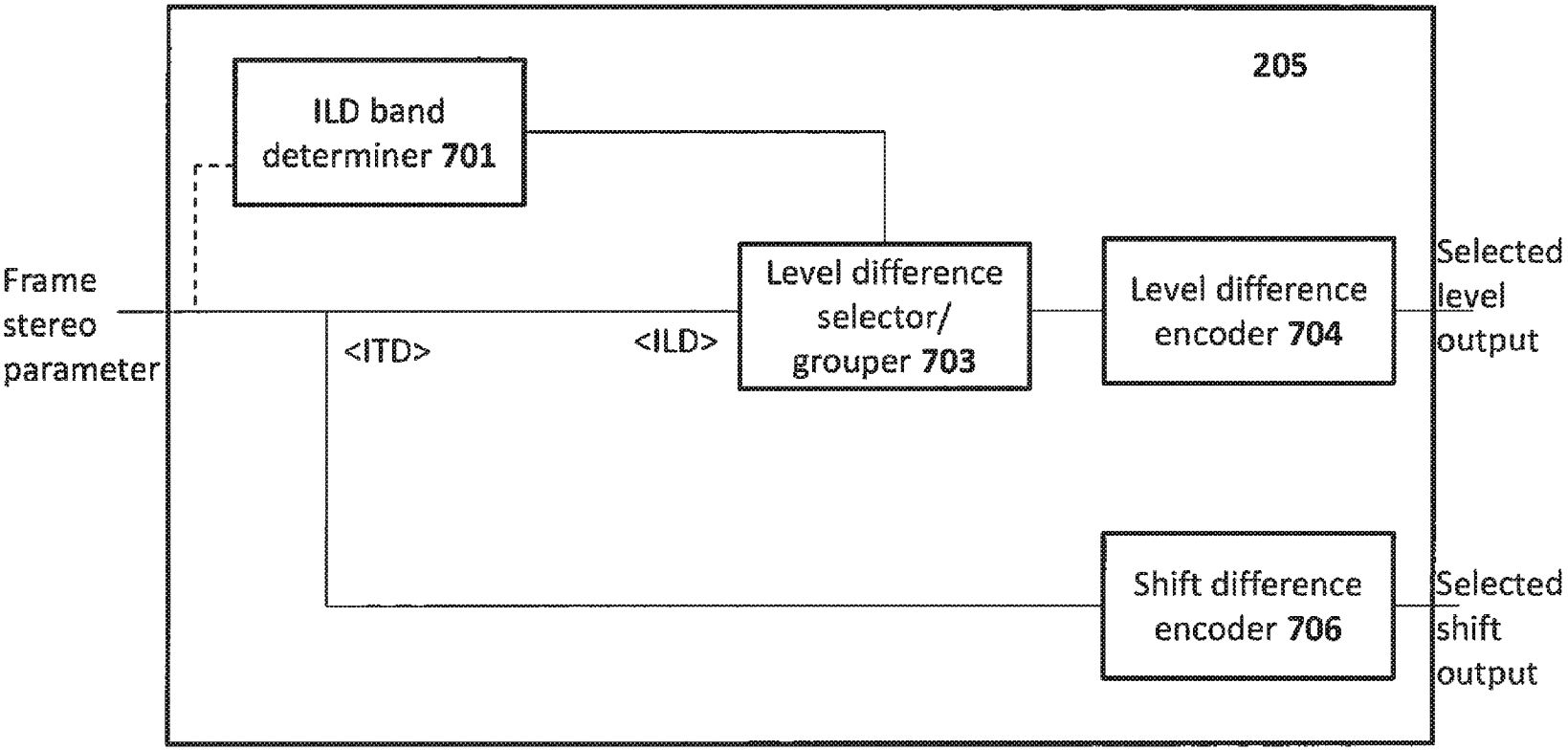
FIG. 5 shows schematically a stereo parameter encoder as shown in FIG. 3 in further detail according to some embodiments.
Figure 6:
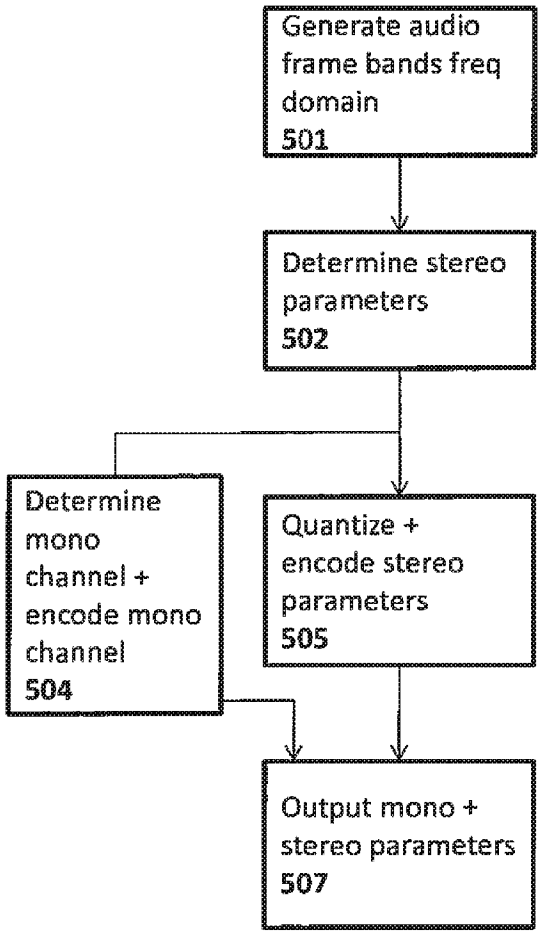
FIG. 6 shows a flow diagram illustrating the operation of the encoder shown in FIG. 3 according to some embodiments.
Figure 7:
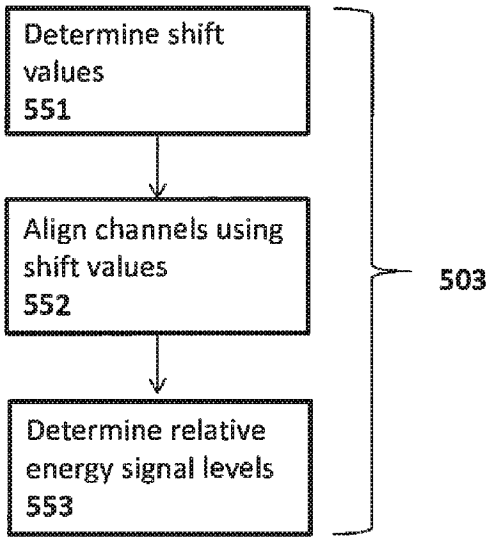
FIG. 7 shows a flow diagram illustrating the operation of the channel analyser as shown in FIG. 4 according to some embodiments.

It would be appreciated that the schematic structures described in FIGS. 3 to 5, and 9, and the method steps shown in FIGS. 6 to 7 and 10 represent only a part of the operation of an audio codec and specifically part of a stereo encoder/decoder apparatus or method as exemplarily shown implemented in the apparatus shown in FIG. 1.

Figure 2:
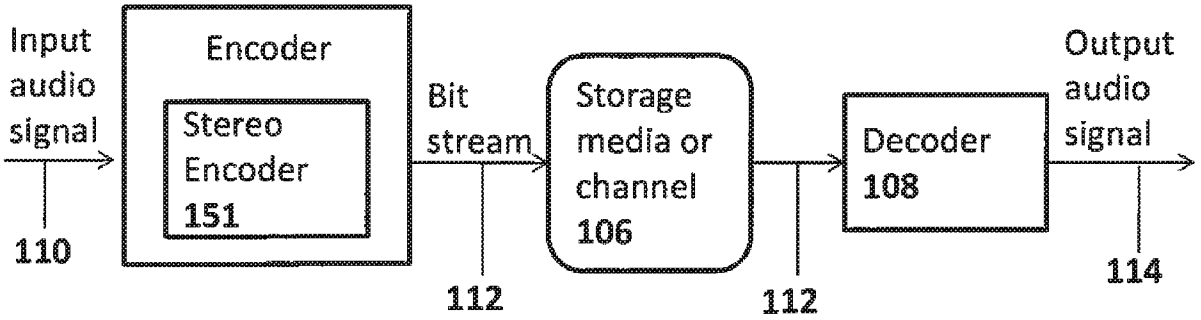
FIG. 2 shows schematically an audio codec system according to some embodiments.

The general operation of audio codecs as employed by embodiments is shown in FIG. 2. General audio coding/decoding systems comprise both an encoder and a decoder, as illustrated schematically in FIG. 2. However, it would be understood that some embodiments can implement one of either the encoder or decoder, or both the encoder and decoder. Illustrated by FIG. 2 is a system 102 with an encoder 104 and in particular a stereo (or more generally a multichannel) encoder 151, a storage or media channel 106 and a decoder 108. It would be understood that as described above some embodiments can comprise or implement one of the encoder 104 or decoder 108 or both the encoder 104 and decoder 108.

The encoder 104 compresses an input audio signal 110 producing a bit stream 112, which in some embodiments can be stored or transmitted through a media channel 106. The encoder 104 furthermore can comprise a stereo (or more generally a multichannel) encoder 151 as part of the overall encoding operation. It is to be understood that the stereo encoder may be part of the overall encoder 104 or a separate encoding module. The encoder 104 can also comprise a multi-channel encoder that encodes more than two audio signals.

The bit stream 112 can be received within the decoder 108. The decoder 108 decompresses the bit stream 112 and produces an output audio signal 114. The decoder 108 can comprise a stereo decoder as part of the overall decoding operation. It is to be understood that the stereo decoder may be part of the overall decoder 108 or a separate decoding module. The decoder 108 can also comprise a multi-channel decoder that decodes more than two audio signals. The bit rate of the bit stream 112 and the quality of the output audio signal 114 in relation to the input signal 110 are the main features which define the performance of the coding system 102.

Figure 3:
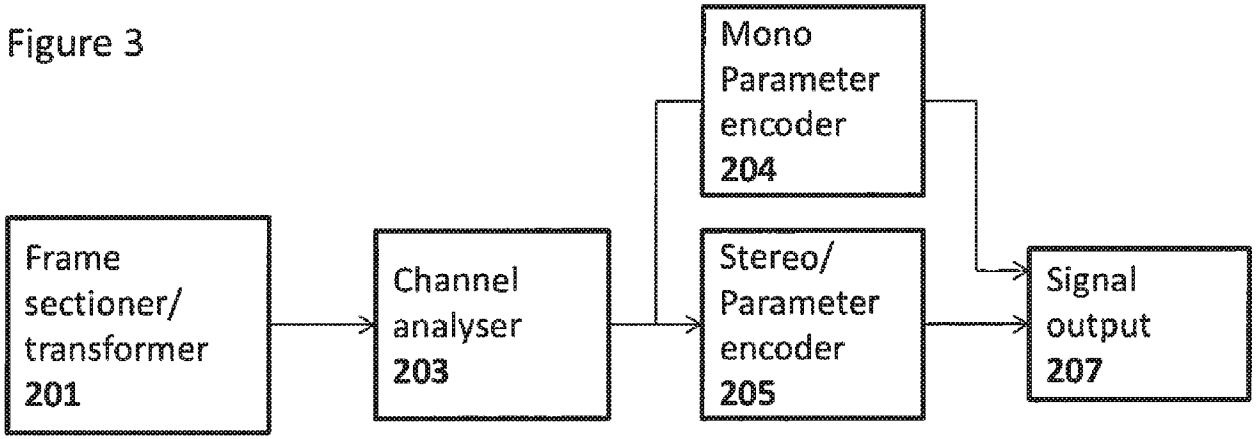
FIG. 3 shows schematically an encoder as shown in FIG. 2 according to some embodiments.

FIG. 3 shows schematically the encoder 104 according to some embodiments. FIG. 6 shows schematically in a flow diagram the operation of the encoder 104 according to some embodiments. In the examples provided herein the input audio signal is a two channel or stereo audio signal, which is analysed and a mono parameter representation is generated from a mono parameter encoder and stereo encoded parameters are generated from a stereo parameter encoder. However it would be understood that in some embodiments the input can be any number of channels which are analysed and a downmix parameter encoder generates a downmixed parameter representation and a channel extension parameter encoder generate extension channel parameters.

The concept for the embodiments as described herein is thus to determine and apply a multichannel (stereo) coding mode to produce efficient high quality and low bit rate real life multichannel (stereo) signal coding. To that respect with respect to FIG. 3 an example encoder 104 is shown according to some embodiments. Furthermore with respect to FIG. 6 the operation of the encoder 104 is shown in further detail.

The encoder 104 in some embodiments comprises a frame sectioner/transformer 201. The frame sectioner/transformer 201 is configured to receive the left and right (or more generally any multi-channel audio representation) input audio signals and generate frequency domain representations of these audio signals to be analysed and encoded. These frequency domain representations can be passed to the channel analyser 203.

In some embodiments the frame sectioner/transformer can be configured to section or segment the audio signal data into sections or frames suitable for frequency domain transformation. The frame sectioner/transformer 201 in some embodiments can further be configured to window these frames or sections of audio signal data according to any suitable windowing function. For example the frame sectioner/transformer 201 can be configured to generate frames of 20 ms which overlap preceding and succeeding frames by 10 ms each.

In some embodiments the frame sectioner/transformer can be configured to perform any suitable time to frequency domain transformation on the audio signal data. For example the time to frequency domain transformation can be a discrete Fourier transform (DFT), Fast Fourier transform (FFT), modified discrete cosine transform (MDCT). In the following examples a Fast Fourier Transform (FFT) is used. Furthermore the output of the time to frequency domain transformer can be further processed to generate separate frequency band domain representations (sub-band representations) of each input channel audio signal data. These bands can be arranged in any suitable manner. For example these bands can be linearly spaced, or be perceptual or psychoacoustically allocated.

The operation of generating audio frame band frequency domain representations is shown in FIG. 6 by step 501.

In some embodiments the frequency domain representations are passed to a channel analyser 203.

In some embodiments the encoder 104 can comprise a channel analyser 203. The channel analyser 203 can be configured to receive the sub-band filtered representations of the multi-channel or stereo input. The channel analyser 203 can furthermore in some embodiments be configured to analyse the frequency domain audio signals and determine parameters associated with each sub-band with respect to the stereo or multi-channel audio signal differences.

The generated mono (or downmix) signal or mono (or downmix) parameters can in some embodiments be passed to the mono parameter encoder 204.

The stereo parameters (or more generally the multi-channel parameters) can be output to the stereo parameter encoder 205.

In the examples described herein the mono (or downmix) and stereo (or channel extension or multi-channel) parameters are defined with respect to frequency domain parameters, however time domain or other domain parameters can in some embodiments be generated.

The operation of determining the stereo (or channel extension or multi-channel) parameters is shown in FIG. 6 by step 503.

With respect to FIG. 4 an example channel analyser 203 according to some embodiments is described in further detail. Furthermore with respect to FIG. 7 the operation of the channel analyser 203 as shown in FIG. 4 is shown according to some embodiments.

In some embodiments the channel analyser/mono encoder 203 comprises a shift determiner 301. The shift determiner 301 is configured to select the shift for a sub-band such that it maximizes the real part of the correlation between the signal and the shifted signal, in the frequency domain. The shifts (or the best correlation indices COR_IND[j]) can be determined for example using the following code.

```
for ( j = 0; NUM_OF_BANDS_FOR_COR_SEARCH; j++ )
{
    cor = COR_INIT;
    for ( n = 0; n < 2*MAXSHIFT + 1; n++ )
    {
        mag[n] = 0.0f;
        for ( k = COR_BAND_START[j]; k <
        COR_BAND_START[j+1]; k++ )
        {
            mag[n] += svec_re[k] * cos( −2*PI*((n−MAXSHIFT) * k
            / L_FFT );
            mag[n] −= svec_im[k] * sin( −2*PI*((n−MAXSHIFT) * k
            / L_FFT );
        }
        if (mag[n] > cor)
        {
            cor_ind[j] = n − MAXSHIFT;
            cor = mag[n];
        }
    }
}
```

Where the value MAXSHIFT is the largest allowed shift (the value can be based on a model of the supported microphone arrangements or more simply the distance between the microphones) PI is π, COR_INIT is the initial correlation value or a large negative value to initialise the correlation calculation, and COR_BAND_START [ ] defines the starting points of the sub-bands. The vectors svec_re [ ] and svec_im [ ], the real and imaginary values for the vector, used herein are defined as follows:

```
svec_re[0] = fft_l[0] * fft_r[0];
svec_im[0] = 0.0f;
for (k = 1; k <
COR_BAND_START[NUM_OF_BANDS_FOR_COR_SEARCH];
k++)
{
    svec_re[k] = (fft_l[k] * fft_r[k])−(fft_l[L_FFT−k] *
    (−fft_r[L_FFT−k]));
    svec_im[k] = (fft_l[L_FFT−k] * fft_r[k]) + (fft_l[k] *
    (−fft_r[L_FFT−k]));
}
```

The operation of determining the correlation values is shown in FIG. 7 by step 553.

The correlation values can in some embodiments be passed to the mono channel encoder 204 and as stereo channel parameters to the stereo parameter encoder 205 and in some embodiments the shift difference selector 705.

Furthermore in some embodiments the shift value is applied to one of the audio channels to provide a temporal alignment between the channels. These aligned channel audio signals can in some embodiments be passed to a relative energy signal level determiner 303.

The operation of aligning the channels using the determined shift value is shown in FIG. 7 by step 552.

In some embodiments the channel analyser/encoder 203 comprises a relative energy signal level determiner 303. The relative energy signal level determiner 303 is configured to receive the output aligned frequency domain representations and determine the relative signal levels between pairs of channels for each sub-band. It would be understood that in the following examples a single pair of channels are analysed by a suitable stereo channel analyser and processed however it would be understood that in some embodiments this operation can be extended to any number of channels (in other words a multi-channel analyser or suitable means for analysing multiple or two or more channels to determine parameters defining the channels or differences between the channels. This can be achieved for example by a suitable pairing of the multichannels to produce pairs of channels which can be analysed as described herein.

In some embodiments the relative level for each band can be computed using the following code.

```
For (j = 0; j < NUM_OF_BANDS_FOR_SIGNAL_LEVELS; j++)
    {
        mag_l = 0.0;
        mag_r = 0.0;
        for (k = BAND_START[j]; k < BAND_START[j+1]; k++)
        {
            mag_l += fft_l[k]*fft_l[k] +
            fft_l[L_FFT−k]*fft_l[L_FFT−k];
            mag_r += fft_r[k]*fft_r[k] +
            fft_r[L_FFT−k]*fft_r[L_FFT−k];
        }
        mag[j] =
        10.0f*log10(sqrt((mag_l+EPSILON)/(mag_r+EPSILON)));
    }
```

Where L_FFT is the length of the FFT and EPSILON is a small value above zero to prevent division by zero problems. The relative energy signal level determiner in such embodiments effectively generates magnitude determinations for each channel (for example in a stereo channel configuration the left channel L and the right channel R) over each sub-band and then divides one channel value by the other to generate a relative value. In some embodiments the relative energy signal level determiner 303 is configured to output the relative energy signal level to the mono (or downmix) parameter encoder 204 and the stereo (or multi-channel or channel extension) parameter encoder 205 and in some embodiments the level difference selector 703.

The operation of determining the relative energy signal level is shown in FIG. 7 by step 553.

In some embodiments any suitable inter level (energy) and inter temporal (shift or delay) difference estimation can be performed. For example for each frame there can be two windows for which the shift (delay) and levels are estimated. Thus for example where each frame is 10 ms there may be two windows which may overlap and are delayed from each other by 5 ms. In other words for each frame there can be determined two separate delay and level difference values which can be passed to the encoder for encoding.

Furthermore in some embodiments for each window the differences can be estimated for each of the relevant sub bands. The division of sub-bands can in some embodiments be determined according to any suitable method.

For example the sub-band division in some embodiments which then determines the number of Inter level (energy) and inter temporal (shift or delay) difference estimation can be performed according to a selected bandwidth determination. For example the generation of audio signals can be based on whether the output signal is considered to be wideband (WB), superwideband (SWB), or fullband (FB) (where the bandwidth requirement increases in order from wideband to fullband). For the possible bandwidth selections there can in some embodiments be a particular division in subbands. Thus for example the sub-band division for the FFT domain for temporal or delay difference estimates can be:

ITD sub-bands for Wideband (WB)
const short scale1024_WB [ ]=
{1, 5, 8, 12, 20, 34, 48, 56, 120, 512};
ITD sub-bands for Superwideband (SWB)
const short scale1024_SWB [ ]=
{1, 2, 4, 6, 10, 14, 17, 24, 28, 60, 256, 512};
ITD sub-bands for Fuliband (FB)
const short scale1024_FB [ ]=
{1, 2, 3, 4, 7, 11, 16, 19, 40, 171, 341, 448/*~21 kHz*/};
ILD sub-bands for Wideband (WB)
const short scf_band WB [ ]=
{1, 8, 20, 32, 44, 60, 90, 110, 170, 216, 290, 394, 512};
ILD sub-bands for Superwideband (SWB)
const short scf_band_SWB [ ]=
{1, 4, 10, 16, 22, 30, 45, 65, 85, 108, 145, 197, 256, 322, 412, 512};
ILD sub-bands for Fuliband (FB)
const short scf_band_FB [ ]=
{1, 3, 7, 11, 15, 20, 30, 43, 57, 72, 97, 131, 171, 215, 275, 341, 391, 448/*~21 kHz*/};

In other words in some embodiments there can be different sub-bands for delays and levels differences.

As shown in FIG. 4 the encoder can further comprise a mono parameter encoder 204 (or more generally the downmix parameter encoder). The operation of the example mono (downmix) parameter encoder 204 is shown in FIG. 8.

In some embodiments the apparatus comprises a mono (or downmix) parameter encoder 204. The mono (or downmix) parameter encoder 204 in some embodiments comprises a mono (or downmix) channel generator/encoder 305 configured to receive the channel analyser values such as the relative energy signal level from the relative energy signal level determiner 303 and the shift level from the shift determiner 301. Furthermore in some embodiments the mono (downmix) channel generator/encoder 305 can be configured to further receive the input stereo (multichannel) audio signals. The mono (downmix) channel generator/encoder 305 can in some embodiments be configured to apply the shift (delay) and level differences to the stereo (multichannel) audio signals to generate an 'aligned' mono (or downmix) channel which is representative of the audio signals. In other words the mono (downmix) channel generator/encoder 305 can generate a mono (downmix) channel signal which represents an aligned stereo (multichannel) audio signal. For example in some embodiments where there is determined to be a left channel audio signal and a right channel audio signal one of the left or right channel audio signals are delayed with respect to the other according to the determined delay difference and then the delayed channel and other channel audio signals are averaged to generate a mono channel signal. However it would be understood that in some embodiments any suitable mono channel generating method can be implemented. It would be understood that in some embodiments the mono channel generator or suitable means for generating audio channels can be replaced by or assisted by a 'reduced' (or downmix) channel number generator configured to generate a smaller number of output audio channels than input audio channels. Thus for example in some multichannel audio signal examples where the number of input audio signal channels is greater than two the 'mono channel generator' is configured to generate more than one channel audio signal but fewer than the number of input channels.

The operation of generating a mono channel signal (or reduced number of channels) from a multichannel signal is shown in FIG. 8 by step 555.

The mono (downmix) channel generator/encoder 305 can then in some embodiments encode the generated mono (downmix) channel audio signal (or reduced number of channels) using any suitable encoding format. For example in some embodiments the mono (downmix) channel audio signal can be encoded using an Enhanced Voice Service (EVS) mono (or multiple mono) channel encoded form, which may contain a bit stream interoperable version of the Adaptive Multi-Rate-Wide Band (AMR-WB) codec.

The operation of encoding the mono channel (or reduced number of channels) is shown in FIG. 8 by step 557.

The encoded mono (downmix) channel signal can then be output. In some embodiments the encoded mono (downmix) channel signal is output to a multiplexer to be combined with the output of the stereo parameter encoder 205 to form a single stream or output. In some embodiments the encoded mono (downmix) channel signal is output separately from the stereo parameter encoder 205.

The operation of determining a mono (downmix) channel signal and encoding the mono (downmix) channel signal is shown in FIG. 6 by step 504.

In some embodiments the encoder 104 comprises a stereo (or extension or multi-channel) parameter encoder 205. In the following example the the multi-channel parameter encoder is a stereo parameter encoder 205 or suitable means for encoding the multi-channel parameters. The stereo parameter encoder 205 can be configured to receive the multi-channel parameters such as the stereo (difference) parameters determined by the channel analyser 203. The stereo parameter encoder 205 can then in some embodiments be configured to perform a quantization on the parameters and furthermore encode the parameters so that they can be output (either to be stored on the apparatus or passed to a further apparatus).

The operation of quantizing and encoding the quantized stereo parameters is shown in FIG. 6 by step 505.

With respect to FIG. 5 an example stereo (multi-channel) parameter encoder 205 is shown in further detail. Furthermore with respect to FIG. 9 the operation of the stereo (multi-channel) parameter encoder 205 according to some embodiments is shown.

In some embodiments the stereo (multi-channel) parameter encoder 205 is configured to receive the stereo (multi-channel) parameters in the form of the channel level differences (ILD) and the channel delay differences (ITD).

The stereo (multi-channel) parameters can in some embodiments be passed to a level difference selector 703, for the ILD values, and a shift difference selector 705 for the ITD values.

The operation of receiving the stereo (multi-channel) parameters is shown in FIG. 9 by step 401.

In some embodiments the stereo parameters are further forwarded to a frame/band determiner 701.

In some embodiments the stereo (multichannel) parameter encoder 205 comprises an inter-level difference band determiner 701. The inter-level difference (ILD) band determiner 701 or suitable means for determining difference parameters to select is configured to receive a variable bit rate value and from this value generate the band selection criteria which can be passed to the level difference selector/grouper 703. In some embodiments the inter-level (ILD) band determiner 701 is configured to receive the sub-band divisions from which the sub-band selection criteria is determined. In some embodiments the ILD band determiner 701 can be configured to determine the sub-band divisions.

Although in the embodiments shown herein the inter-level difference band determiner 701 or more generally a difference band determiner or means for determining selections of difference parameters is configured to determine a grouping or selection criteria for inter-level difference values it would be understood that in general a band determiner can be configured to determine groups of any suitable difference value used to generate the multichannel or extension parameters. Thus for example the inter-time or inter-temporal difference (ITD) values can be grouped based on the available number of bits for the multichannel extension.

In some embodiments the band grouping or selection criteria can differ between the various difference parameters which are processed according to these embodiments. For example in some embodiments where both the ITD and ILD are grouped and encoded according to groups the level difference selector/grouper can be configured to select different bands to be grouped according to a ILD grouping criteria and the shift difference selector/grouper configured to select or group sub-band ITD values according to a separate ITD grouping criteria.

The difference band determiner, for example the inter-level difference band determiner 701 can in some embodiments further generate selection criteria based on the operating mode of the encoder. For example in some embodiments the encoder can be configured to operate in a full or normal mode, wideband (WB) or super wideband (SWB) mode. In such embodiments for each mode the inter-level difference band determiner 701 can be configured to generate grouping criteria thresholds which generate different grouping criteria dependent on the comparison between the input available bit rate (or bits available for the frame) and the threshold values. An example grouping criteria can be selecting groups of 1 (in other words enabling the encoder to generate a representation of each individual sub-band difference values), groups of 2 (in other words enabling the encoder to generate a representation for pairs of sub-band difference values), and groups of 4 (in other words enabling the encoder to generate a representation for groups of 4 sub-band difference values).

For example a pseudocode example of the setting of thresholds and determining grouping criteria is shown as follows.

```
if {st->input_Fs == 48000}
{
    level_vec_len = 2* ST_NBANDS; //17;
        freq_idx = 2;
        lim1 = 4750;
        lim2 = 3100;
}
else if {st->input_Fs == 32000}
{
    level_vec_len = 2* ST_NBANDS_SWB;
        freq_idx = 0;
        lim1 = 4350;
        lim2 = 2900;
}
else if {st->input_Fs == 16000}
{
    level_vec_len = 2* ST_NBANDS_WB;
        freq_idx = 1;
        lim1 = 3750;
        lim2 = 2650;
 }
if {st->ster_brate > lim1}
{
  dim = 1;
}
else if {st->ster_brate>lim2}
{
  dim = 2;
}
else
{
  dim = 4;
}
```

In the pseudocode shown herein the sampling rate of the input difference parameter values is determined and compared against series of determined values to establish the operating mode of the encoder. Thus where the sampling rate is 48 kHz (st->input_Fs==48000) then a full band series of thresholds are generated. In the example shown in the pseudo-code herein the full band thresholds are defined as a first threshold lim1=4750 bits/s and a second threshold lim2=3100 bits/s. Where the sampling rate is 32 kHz (st->input_Fs==32000) then the super-wide band (SWB) first threshold lim1=4350 bits/s and the second threshold lim2=2900 bits/s is determined. Where the input frequency is 16 kHz (st->input_Fs==16000) then the wide band (WB) first threshold lim1=3750 bits/s and the second threshold lim2=2650 bits/s is determined. It would be understood that in some embodiments the threshold can be expressed as a number of bits per frame which can be obtained by dividing the above values by 50, in the example where the frame is 20 ms long.

In the pseudocode then the available bits ster_brate is compared against the determined thesholds lim1 and lim2 and the grouping criteria for the frame is determined. In the following example where the number of available bits is greater than the first threshold value (lim1) then the inter-level difference band determiner 701 can be configured to generate a grouping criteria where each of the inter-level differences are grouped individually (dim=1). In other words it enables the encoder to generate a representation of each individual sub-band difference value. Where the available bit rate falls between the first threshold lim1 and the second threshold lim2 the inter-level difference band determiner 701 is configured to generate a grouping criteria wherein multiples of two level differences are grouped or selected and a single encoding value used to represent these pairs or group of two values (dim=2). In other words it enables the encoder to generate a representation for pairs of sub-band difference values. When the available number of bits or bit rate is below the second threshold lim2 then the ILD band determiner 701 can be configured to generate a selection criteria wherein groups of four difference values are grouped or selected and a single encoded value generated for each group of four difference values (dim=4). In other words it enables the encoder to generate a representation for groups of 4 sub-band difference values.

In some embodiments the ILD band determiner is configured to determine or generate the grouping or selection criteria in terms of selecting which elements are to be grouped. In some embodiments the selection criteria is one of grouping consecutive sub-bands. For example where there are 24 sub-band level parameters indexed 1 to 24 then individual groupings can be defined by the set {(1), (2), (3), . . . , (24)} where ( ) defines the groupings. Similarly where pairs of groupings are determined then the 24 sub-band level difference parameters can be grouped according to {(1, 2), (3, 4), . . . , (23, 24)} and groups of 4 represented by {(1, 2, 3, 4), (5, 6, 7, 8), . . . (21, 22, 23, 24)}.

However it would be understood that in some embodiments any suitable grouping criteria for selecting and grouping sub band difference values can be used. For example in some embodiments the sub bands which are selected and grouped can have some relationship between them (such as being harmonic values).

Furthermore it would be understood that in some embodiments the level parameters are based on an interlacing of frames. In such embodiments a first frame can generate a first set of parameters and the next frame a second set of parameters such that over two frames a full set of parameters can be generated. In some embodiments it would be understood that the interlacing can be performed over more than two frames.

Thus in some embodiments the ILD band determiner can configured to determine or generate the grouping or selection criteria in terms of selecting which elements are to be grouped further based on which of the interlaced frames is being processed. Thus for example in some embodiments the ILD band determiner is configured to determine or generate the grouping or selection criteria in terms of selecting to group the frame parameters which have been generated in the current frame. Thus for example in some embodiments the selection criteria is one of grouping consecutive sub-bands. For example where there are 24 sub-band level parameters indexed 1 to 24 and the current frame is configured to generate the odd sub-band level defined by the set {1, 3, . . . , 23} then the ILD band determiner can individually group the set according to {(1), (3), (5), . . . , (23)} where ( ) defines the groupings. Similarly where pairs of groupings are determined then the odd indexed 12 from the 24 sub-band level difference parameters can be grouped according to {(1, 3), (5, 7), . . . , (21, 23)} and groups of 4 represented by {(1, 3, 5, 7), (9, 11, 13, 15), (17, 19, 21, 23)}.

It would be understood that in some embodiments any suitable interlacing and grouping combination can be employed. For example in some embodiments the frames are interlaced such that parameters are generated for odd and even positions in alternating frames, however the grouping criteria is such that each encoded value group represents a pair of parameters. Furthermore from each pair of parameters one of which is from the current frame and one is from a previous frame. For example for a first frame the pair groupings for the 24 sub-band level difference parameter example can be {(1, 2), (3, 4), . . . , (23, 24)}, where the bold index is the current frame generated parameter and the normal index the previous frame generated index and for a second frame the pair groupings for the 24 sub-band level difference parameter example can be {(1, 2), (3, 4), . . . , (23, 24)}, where the bold index is the second frame generated parameter and the normal index the previous first frame generated index. The concept related to such embodiments is that that the difference values such as the level differences from adjacent subbands will typically have similar (or correlated) values. These examples can further be expanded to dim=4.

In the example shown herein the number or dimension of sub bands which are grouped are a multiple of two however it would be understood that in some embodiments any grouping number or numbers can be used.

Furthermore in some embodiments a variable grouping number or dimension across the level vector can be employed. For example in some embodiments the inter-level difference band determiner 701 can be configured to generate a selection or grouping criteria which groups the lower frequency sub-band parameters with a first grouping dimension criteria (for example producing pairs of difference values or groups of four difference values or any other suitable number or dimension of elements per group) and generating a second grouping dimension criteria for higher frequency sub-band parameters such as grouping the higher sub-band parameters individually.

In some embodiments the ILD band determiner 701 can be configured to determine the grouping criteria based on an estimate of the number of bits required to encode a level difference parameter value. For example where it is estimated that the level difference encoder requires approximately 2.5 bits per parameter value (nBL=2.5) to generate a sufficient quality output the ILD band determiner 701 can be configured to determine the number of parameters that need to be coded and knowing the number of bits available perform a variable dimensional grouping determination such that a number of the sub-band parameters are included in groups and another number of parameters are encoded individually. For example in some embodiments for the wide band case (WB) there are 24 level parameters to be encoded and where there are 40 bits available to encode the 24 level parameters then the ILD band determiner can be configured to generate a grouping criteria such that on average 16 parameters or groups of parameters can be encoded. Thus for example the number of parameters are split between pairs and individually grouped encoded parameter then out of 24 parameters to be encoded there are 16 parameters encoded as 8 pair-encoded (pair grouped) parameters and 8 Individually encoded (individually grouped) parameters.

In the embodiments as described herein the grouping criteria is such that for each frame all of the difference parameters are selected and grouped (including the individually grouped parameters). However it would be understood that in some embodiments the grouping criteria determined by the ILD band determiner 701 (or other band determiner or more generally extension parameter determiner) is not a complete set selection. In other words in some embodiments the determiner is configured to select and group a sub-set of the frame parameters and not select some of the parameters and thus not all of the set of parameters determined for a frame are encoded. In such embodiments the sub-set of parameters are encoded and the missing or non-selected parameters are regenerated from earlier frames at the decoder.

The grouping or selection criteria can be passed to the level difference selector/grouper 703.

The operation of determining/receiving the bits available to encode the extension parameter is shown in FIG. 9 by step 403.

The operation of generating the parameter grouping/selection based criteria is shown in FIG. 9 by step 405.

In some embodiments the stereo (multi-channel) parameter encoder 205 comprises a level difference selector 703. The level difference selector 703 is configured to receive the inter-level differences (ILD) frame stereo (multi-channel) parameters and furthermore to receive the sub-band grouping/selections from the ILD band determiner 701. The level difference selector 703 is then configured to group (or select) the ILD parameters for the indicated sub-bands. The grouped level difference values can be passed to a level difference encoder 704.

The operation of grouping the difference parameters based on the grouping criteria is shown in FIG. 9 by step 407.

In some embodiments the stereo (multi-channel) parameter encoder comprises a level difference encoder 704 the level difference encoder 704 is configured to encode or quantize in a suitable manner the grouped level difference parameters selected by the level difference selector/grouper 703 and output the selected level and values in an encoded form. In some embodiments these can be multiplexed with the mono (downmix) encoded signals or be passed separately to a decoder (or memory for storage).

In some embodiments the level difference encoder 704 can perform the following operations in order to generate the encoded parameters associated with the grouped parameters by generated a pseudo-vector quantized output where the grouping dimension was greater than 1.

```
void
scalar_quantize_domain_muiti{
        float * in,             /* (i) input param vector */
        short * idx,            /* (o) quant index */
        short len,              /* (i) param vector length */
        short len_table,        /* (i) codebook size */
        const float * table,    /* (i) 1D codebook */
        short * p_min_j,        /* (o) pointer to index of minimum
quantized value */
        short * p_msx_j,        /* (o) pointer to index of maximun
quantized value */
        short dim               /* (i) group (subvector) size, valid over
the entire vector */}
{
    float dist, min_dist, tmp;
    short min_j =NO_SYMB_LEVEL+1, max_j=0, i, j, k, best_j, crt;
    short dim1 = 0, no_vec;
    no_vec = (short)(len/dim);
    dim1 = len - no_vec*dim;
    /* cover the cases when len is not a multiple of dim */
    if (dim1>0)
    {
        no_vec++;
    }
    /* pseudo-vector quantize */
    for (i=0;i<no_vec;i++)
    {
        if ((i==no_vec-1)&&(dim1>0))
        {
            dim = dim1;
        }
        min_dist = 1000000.0;
        best_j = 0;
```

-continued

```
        for(j=0;j<len_table;j++)
        {
            crt = i*dim;
            dist = 0.0f;
            for(k=0;k<dim;k++)
            {
                tmp = in[crt+k]-table[j]; /* same value for
all subvector components */
                tmp*=tmp;
                dist += tmp;
            }
            if (dist < min_dist)
            {
                min_dist = dist;
                best_j = j;
            }
        }
        for(k=0;k<dim;k++)
        {
            in[dim*i+k] = table[best_j]; /* dequantized */
            idx[dim*i+k] = best_j;
        }
        if (best_j<min_j)
        {
            min_j = best_j;
        {
        if (best_j>max_j)
        {
            max_j = best_j;
        }
    }
    *p_min_j = min_j+1;
    *p_max_j = max_j+1;
}
}
```

Similarly the stereo (multi-channel) parameter encoder 205 in some embodiments comprises a shift difference encoder 706 configured to receive the selected shift difference parameters and encode the shift difference parameters in a suitable manner for example vector quantisation.

The operation of encoding the grouped selected parameters (as well as the other parameters) is shown in FIG. 9 by step 409.

Furthermore the outputting of encoded selected parameters is shown in FIG. 9 by step 411.

Figure 11:
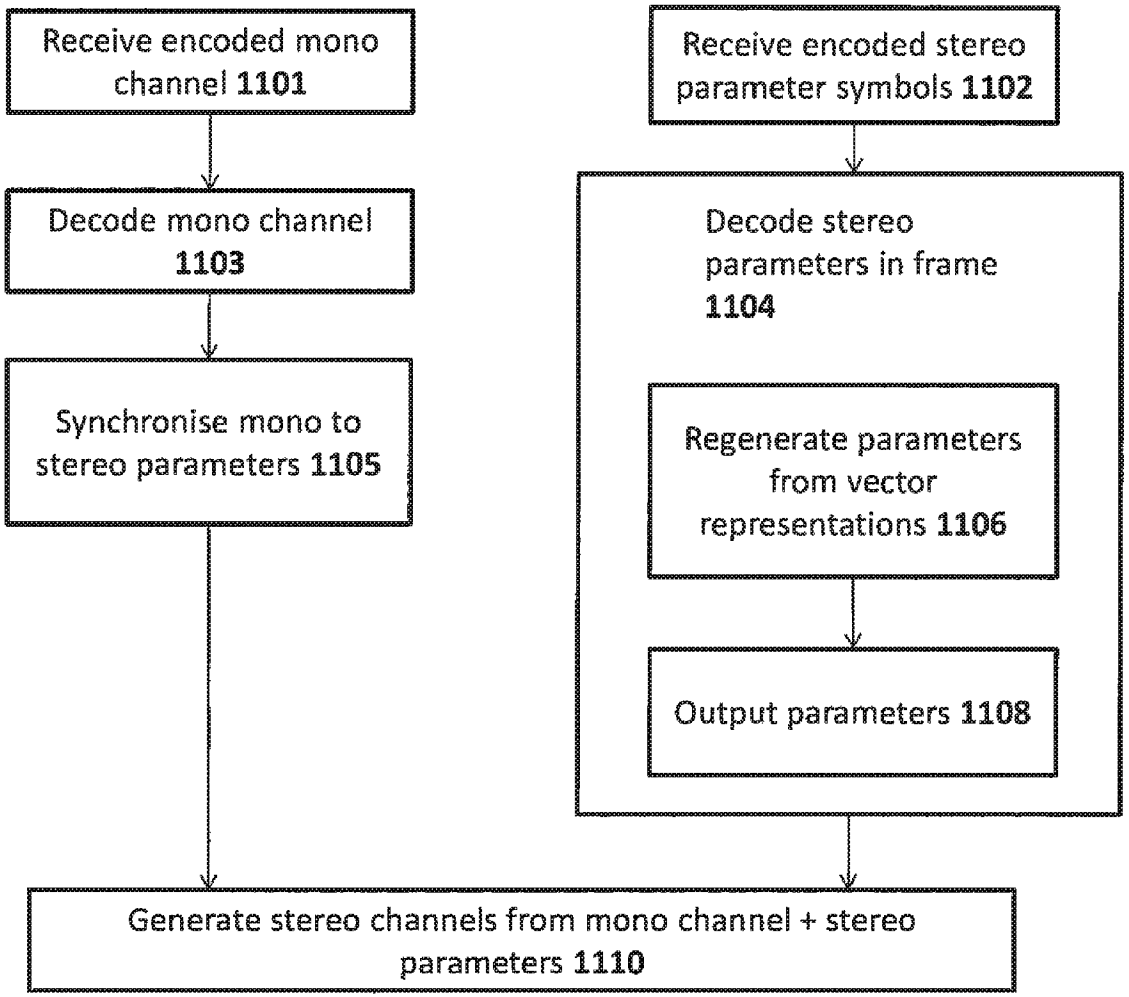
FIG. 11 shows a flow diagram illustrating the operation of the decoder as shown in FIG. 10 according to some embodiments.

In order to fully show the operations of the codec FIGS. 10 and 11 show a decoder and the operation of the decoder according to some embodiments. In the following example the decoder is a stereo decoder configured to receive a mono channel encoded audio signal and stereo channel extension or stereo parameters, however it would be understood that the decoder is a multichannel decoder configured to receive any number of channel encoded audio signals (downmix channels) and channel extension parameters.

In some embodiments the decoder 108 comprises a mono (downmix) channel decoder 1001. The mono (downmix) channel decoder 1001 is configured in some embodiments to receive the encoded mono (downmix) channel signal.

The operation of receiving the encoded mono (downmix) channel audio signal is shown in FIG. 11 by step 1101.

Furthermore the mono (downmix) channel decoder 1001 can be configured to decode the encoded mono (downmix) channel audio signal using the inverse process to the mono (downmix) channel encoder shown in the encoder.

The operation of decoding the mono (downmix) channel is shown in FIG. 11 by step 1103.

In some embodiments the decoder further is configured to output the decoded mono (downmix) signal to the stereo (multichannel) channel generator 1009 such that the decoded mono (downmix) signal is synchronised or received substantially at the same time as the decoded stereo (multichannel) parameters from the parameter set compiler 1005.

The operation of synchronising the mono to stereo parameters is shown in FIG. 10 by step 1105.

In some embodiments the decoder 108 can comprise a stereo (multi-channel) channel decoder 1003. The stereo (multi-channel) channel decoder 1003 is configured to receive the encoded stereo (multi-channel) parameters.

The operation of receiving the encoded stereo (multi-channel) parameters is shown in FIG. 11 by step 1102.

Furthermore the stereo (multi-channel) channel decoder 1003 can be configured to decode the stereo (multi-channel) channel signal parameters by applying the inverse processes to that applied in the encoder. For example the stereo (multi-channel) channel decoder can be configured to output decoded stereo (multi-channel) parameters by applying the reverse of the shift difference encoder and level difference encoder.

The operation of decoding the stereo (multi-channel) parameters is shown in FIG. 11 by step 1104.

The stereo (multi-channel decoder 1003 can thus in some embodiments regenerate the individually grouped parameter values and furthermore regenerate the pair-wise and other multiple grouped parameter values using the reverse of the vector or pseudo-vector quantization operation performed in the encoder (for example within the inter-level parameter encoder).

The sub-step of regenerating the parameters from the vector representations is shown in FIG. 11 by step 1106.

The sub-step of outputting the regenerated parameters is shown in FIG. 11 by step 1108.

In some embodiments where a non-complete set of parameters is selected then the decoder comprises a parameter set compiler 1005 (as shown by the optional dashed box in FIG. 10). The parameter set compiler 1005 is configured to receive the decoded stereo (multi-channel) parameters and configured to replace any previous frame (or old) stereo (multi-channel) parameters with newly decoded frame parameters where replacement sub-band parameters are in the decoded frame.

The parameter set compiler 1005 thus contains a set of stereo (multi-channel) parameters containing all of the sub-band stereo parameters from the most recently received frames. These parameters can be passed to a stereo (multi-channel) channel generator 1009.

In some embodiments the decoder comprises a stereo channel generator 1009 configured to receive the decoded stereo parameters and the decoded mono channel and regenerate the stereo channels in other words applying the level differences (extension parameters) to the mono (downmixed) channel to generate a second (or extended) channel.

The operation of generating the stereo (multi-channel) channels from the mono (downmixed) channel and stereo (extension) parameters is shown in FIG. 11 by step 1010.

Figure 12:
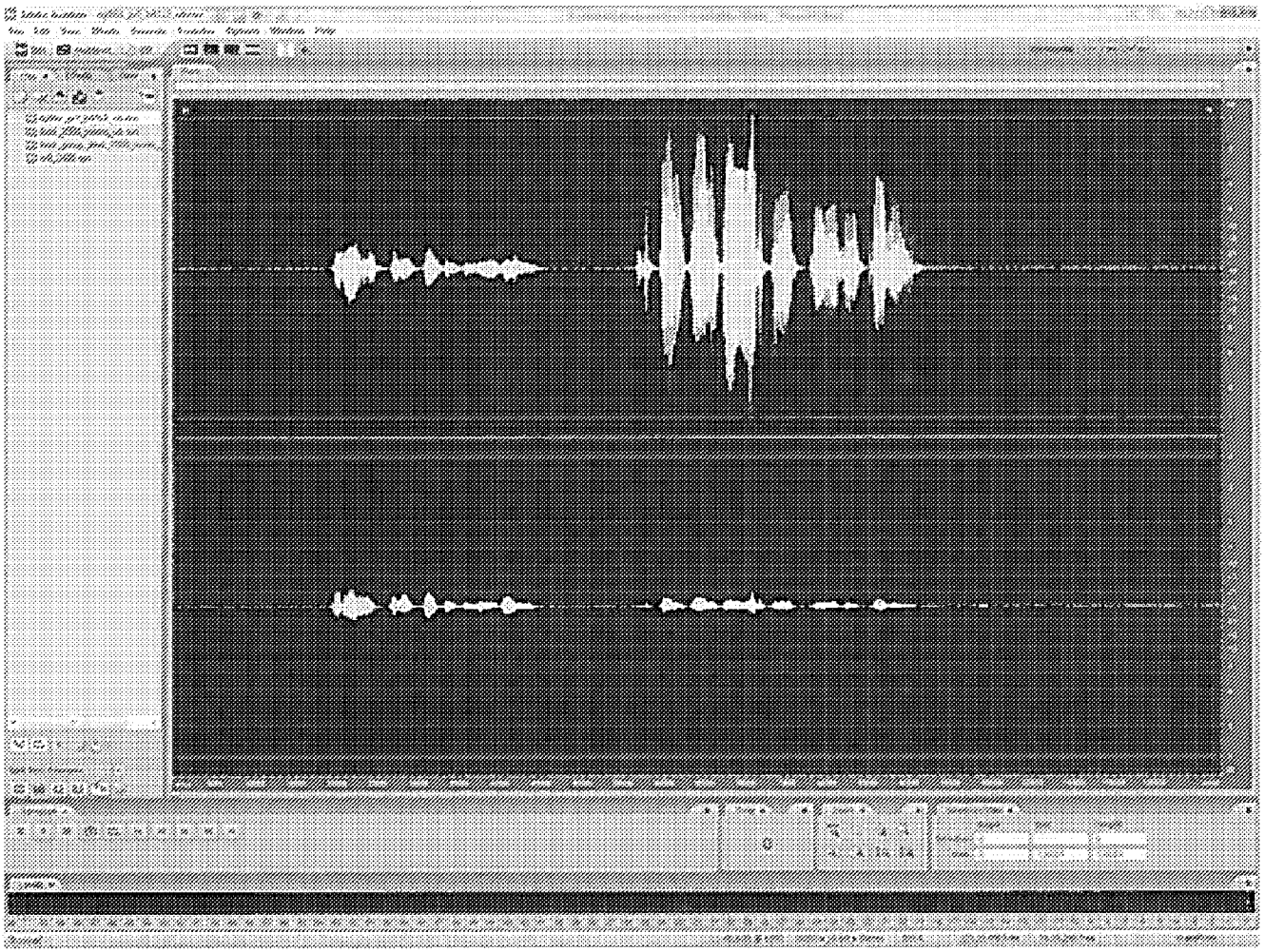
FIGS. 12 to 14 show graphical examples of example encodings according to some embodiments.
Figure 13:
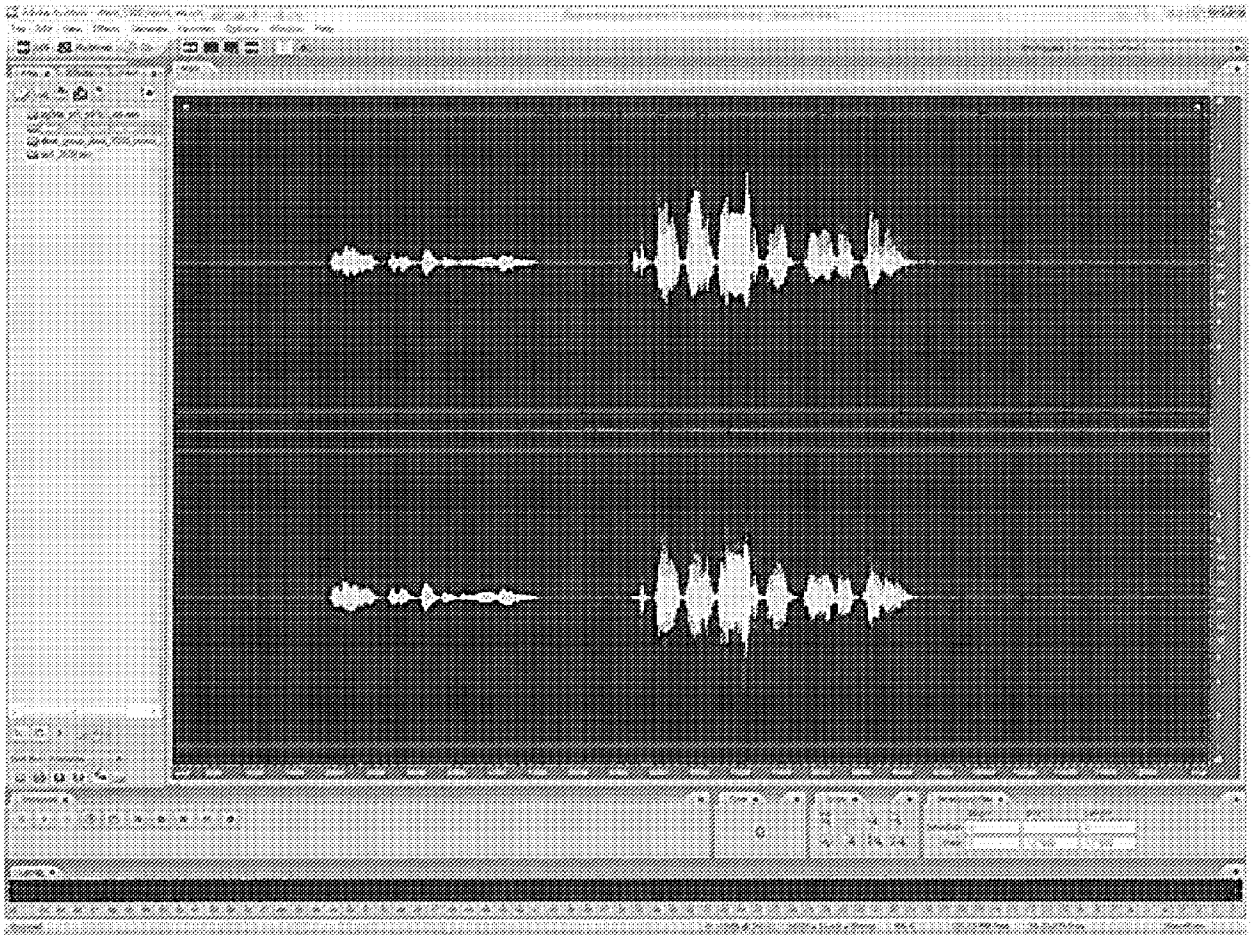
Figure 14:
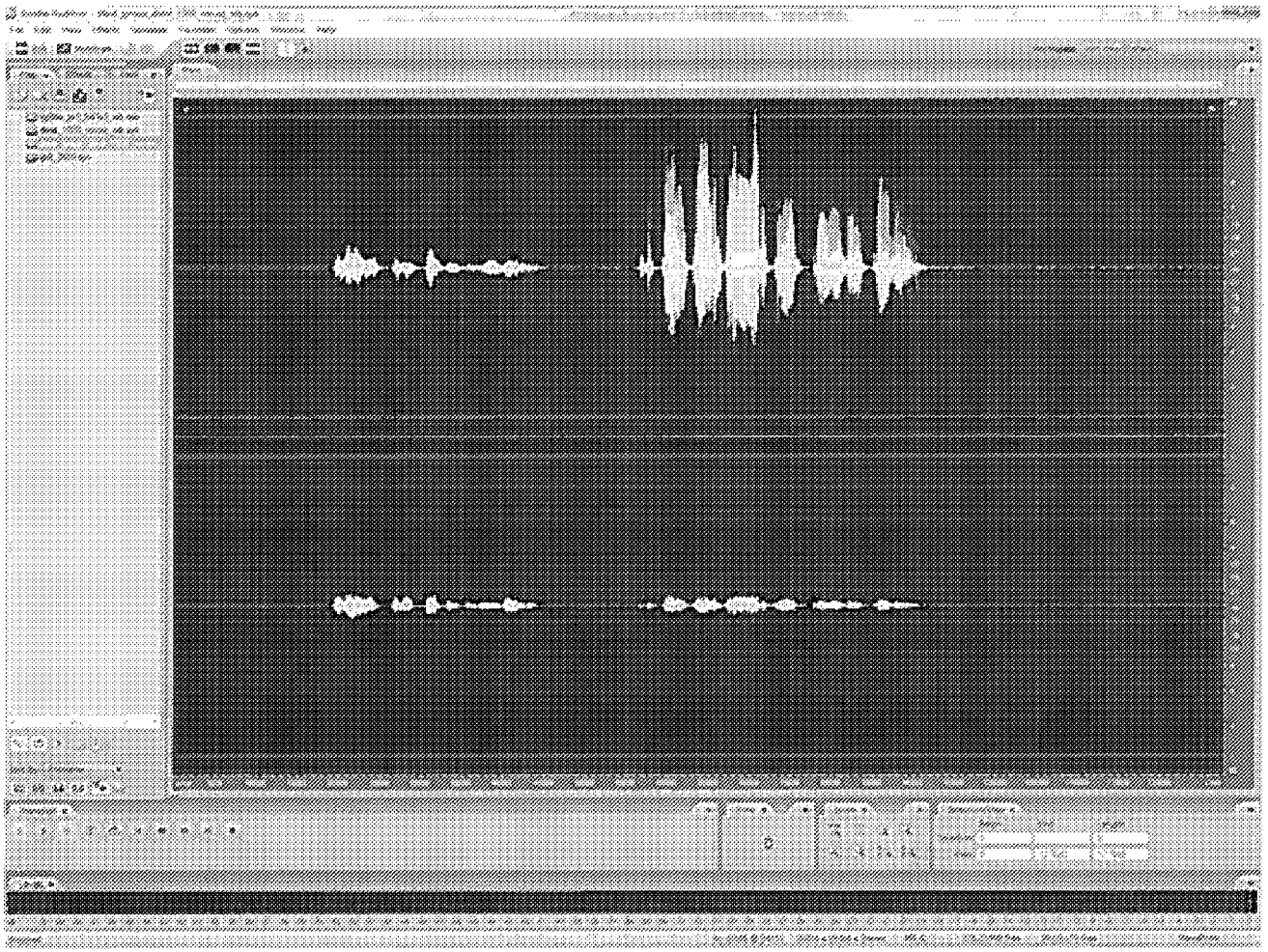

With respect to FIG. 12 to 14 an example of the grouping or encoding the level difference parameters using a limited number of bits are shown. FIG. 12 shows an original signal, FIG. 13 an example of a regenerated conventional WB encoded signal where the left and right channels are unlike the original. FIG. 14 shows a regenerated WB grouped parameter encoded signal which is more similar to the original than the conventionally encoded version shown in FIG. 13.

Although the above examples describe embodiments of the application operating within a codec within an apparatus 10, it would be appreciated that the invention as described below may be implemented as part of any audio (or speech) codec, including any variable rate/adaptive rate audio (or speech) codec. Thus, for example, embodiments of the application may be implemented in an audio codec which may implement audio coding over fixed or wired communication paths.

Thus user equipment may comprise an audio codec such as those described in embodiments of the application above.

It shall be appreciated that the term user equipment is intended to cover any suitable type of wireless user equipment, such as mobile telephones, portable data processing devices or portable web browsers.

Furthermore elements of a public land mobile network (PLMN) may also comprise audio codecs as described above.

In general, the various embodiments of the application may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the application may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this application may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the application may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

As used in this application, the term 'circuitry' refers to all of the following:

(a) hardware-only circuit implementations (such as Implementations in only analog and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including any claims. As a further example, as used in this application, the term 'circuitry' would also cover an implementation of merely a processor (or multiple processors) or portion of a processor and its (or their) accompanying software and/or firmware. The term 'circuitry' would also cover, for example and if applicable to the particular claim element, a baseband integrated circuit or applications processor integrated circuit for a mobile phone or similar integrated circuit in server, a cellular network device, or other network device.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. An apparatus comprising at least one processor and at least one memory including computer program code for one or more programs, the at least one memory and the computer program code configured to, with the at least one processor, cause the apparatus at least to:

determine for a first frame of at least one audio signal a set of first frame audio signal multi-channel parameters;

determine a coding bitrate for the first frame of the at least one audio signal;

select for the first frame groups of elements of the set of first frame audio signal multi-channel parameters based on the coding bitrate for the first frame of the at least one audio signal; and generate an encoded first frame audio signal multi-channel parameter based on the selected groups of elements of first frame audio signal multi-channel parameters.

2. The apparatus as claimed in claim 1, wherein the apparatus caused to determine for a first frame of at least one audio signal a set of first frame audio signal multi-channel parameters is further caused to determine a set of differences between at least two channels of the at least one audio signal, wherein the set of differences comprises two or more difference values, where each difference value is associated with a sub-division of resources defining the first frame.

3. The apparatus as claimed in claim 2, wherein the apparatus caused to determine a set of differences between at least two channels of the at least one audio signal is further caused to determine at least one of:

at least one interaural time difference; and at least one interaural level difference.

4. The apparatus as claimed in claim 2, wherein the sub-division of resources defining the first frame comprises at least one of:

sub-band frequencies; and time periods.

5. The apparatus as claimed in claim 1, wherein the apparatus caused to select for the first frame groups of elements of the set of first frame audio signal multi-channel parameters based on the coding bitrate for the first frame of the at least one audio signal is further caused to:

determine a number of the elements within the set of first frame audio signal multichannel parameters;

determine a number of groups of elements to be selected; and arrange the elements into the number of groups by grouping successively indexed elements such that in each group there are the rounded result of the number of the elements within the set divided by the number of groups of elements to be selected.

6. The apparatus as claimed in claim 1, wherein the apparatus caused to select for the first frame groups of elements of the set of first frame audio signal multi-channel parameters based on the coding bitrate for the first frame of the at least one audio signal is further caused to:

generate first groups of elements of the set of first frame audio signal multi-channel parameters, with a first number of elements per group; and generate second groups of elements of the set of first frame audio signal multi-channel parameters, with a second number of elements per group.

7. The apparatus as claimed in claim 6, wherein the apparatus caused to generate first groups of elements of the set of first frame audio signal multi-channel parameters, with a first number of elements per group is further caused to generate first groups of elements where the elements represent lower frequency first frame audio signal multi-channel parameters, and wherein the apparatus caused to generate second groups of elements of the set of first frame audio signal multi-channel parameters, with a second number of elements per group is further caused to generate second groups of elements where the elements represent higher frequency first frame audio signal multi-channel parameters.

8. The apparatus as claimed in claim 1, wherein to the apparatus caused to generate the encoded first frame audio signal multi-channel parameter based on the selected groups of elements of the set of first frame audio signal multi-channel parameters is further caused to generate an encoded parameter for each of the groups of elements of the at least one first frame audio signal multi-channel parameter using vector or scalar quantization codebooks.

9. The apparatus as claimed in claim 8, wherein the apparatus caused to generate the encoded parameter for each of the groups of elements of the at least one first frame audio signal multi-channel parameter using vector or scalar quantization codebooks is further caused to:

generate a first encoding mapping with an associated index for the at least one first frame audio signal multi-channel parameter dependent on a frequency distribution of mapping instances of the at least one group of elements of the first frame audio signal multi-channel parameter; and encode the first encoding mapping dependent on the associated index.

10. The apparatus as claimed in claim 9, wherein the apparatus caused to encode the first encoding mapping dependent on the associated index is further caused to apply a Golomb-Rice encoding to the first encoding mapping dependent on the associated index.

11. The apparatus as claimed in claim 1, further caused to:

receive at least two audio signal channels;

determine a fewer number of channels audio signal from the at least two audio signal channels and the at least one first frame audio signal multi-channel parameter;

generate an encoded audio signal comprising the fewer number of channels;

combine the encoded audio signal and the encoded at least one first frame audio signal multi-channel parameter.

12. A method comprising:

determining for a first frame of at least one audio signal a set of first frame audio signal multi-channel parameters;

determining a coding bitrate for the first frame of the at least one audio signal;

selecting for the first frame groups of elements of the set of first frame audio signal multi-channel parameters based on the coding bitrate for the first frame of the at least one audio signal; and generating an encoded first frame audio signal multi-channel parameter based on the selected groups of elements of the set of first frame audio signal multi-channel parameters.

13. The method as claimed in claim 12, wherein determining for a first frame of at least one audio signal a set of first frame audio signal multi-channel parameters comprises determining a set of differences between at least two channels of the at least one audio signal, wherein the set of differences comprises two or more difference values, where each difference value is associated with a sub-division of resources defining the first frame.

14. The method as claimed in claim 13, wherein determining a set of differences between at least two channels of the at least one audio signal comprises determining at least one of:

at least one interaural time difference; and at least one interaural level difference.

15. The method as claimed in claim 13, wherein the sub-division of resources defining the first frame comprises at least one of:

sub-band frequencies; and time periods.

16. The method as claimed in claim 12, wherein selecting for the first frame groups of elements of the set of first frame audio signal multi-channel parameters based on the coding bitrate for the first frame of the at least one audio signal comprises:

determining a number of the elements within the set of first frame audio signal multichannel parameters;

determining a number of groups of elements to be selected; and arranging the elements into the number of groups by grouping successively indexed elements such that in each group there are the rounded result of the number of the elements within the set divided by the number of groups of elements to be selected.

17. The method as claimed in claim 12, wherein selecting for the first frame groups of elements of the set of first frame audio signal multi-channel parameters based on the coding bitrate for the first frame of the at least one audio signal comprises:

generating first groups of elements of the set of first frame audio signal multi-channel parameters, with a first number of elements per group; and generating second groups of elements of the set of first frame audio signal multi-channel parameters, with a second number of elements per group.

18. The method as claimed in claim 17, wherein generating first groups of elements of the set of first frame audio signal multi-channel parameters, with a first number of elements per group comprises generating first groups of elements where the elements represent lower frequency first frame audio signal multi-channel parameters and wherein generating second groups of elements of the set of first frame audio signal multi-channel parameters, with a second number of elements per group comprises generating second groups of elements where the elements represent higher frequency first frame audio signal multi-channel parameters.

19. The method as claimed in claim 12, wherein generating the encoded first frame audio signal multi-channel parameter based on the selected groups of elements of the set of first frame audio signal multi-channel parameters comprises generating an encoded parameter for each of the groups of elements of the at least one first frame audio signal multi-channel parameter using vector or scalar quantization codebooks.

20. The method as claimed in claim 19, wherein generating the encoded parameter for each of the groups of elements of the at least one first frame audio signal multi-channel parameter using vector or scalar quantization codebooks comprises:

generating a first encoding mapping with an associated index for the at least one first frame audio signal multi-channel parameter dependent on a frequency distribution of mapping instances of the at least one group of elements of the first frame audio signal multi-channel parameter; and applying a Golomb-Rice encoding to the first encoding mapping dependent on the associated index.

* * * * *